US006669821B2

(12) United States Patent
Edwards et al.

(10) Patent No.: US 6,669,821 B2
(45) Date of Patent: Dec. 30, 2003

(54) APPARATUS FOR MAXIMIZING WATER REMOVAL IN A PRESS NIP

(75) Inventors: Steven L. Edwards, Fremont, WI (US); Robert J. Marinack, Oshkosh, WI (US); Jeffrey Charles McDowell, Appleton, WI (US); Gary L. Worry, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 09/987,248

(22) Filed: Nov. 14, 2001

(65) Prior Publication Data

US 2002/0088595 A1 Jul. 11, 2002

Related U.S. Application Data

(60) Division of application No. 09/439,610, filed on Nov. 12, 1999, which is a continuation-in-part of application No. 09/191,376, filed on Nov. 13, 1998, now Pat. No. 6,248,210.

(51) Int. Cl.[7] ..... D21F 3/00; D21F 7/00

(52) U.S. Cl. ..... 162/358.1; 162/358.2; 162/358.3; 162/361

(58) Field of Search ..... 162/358.1–358.3, 162/360.2–360.3, 900–902, 361, 109, 111; 139/383 R, 383 A; 442/181, 187–192, 203, 220, 270, 307, 314, 320, 227, 333, 366; 428/205, 304.4, 316.6, 306.6

(56) References Cited

U.S. PATENT DOCUMENTS

| | | | |
|---|---|---|---|
| 3,301,746 | A | 1/1967 | Sanford et al. |
| 3,434,918 | A | 3/1969 | Bernardin |
| 3,545,705 | A | 12/1970 | Hodgson |
| 3,549,742 | A | 12/1970 | Benz |
| 3,556,932 | A | 1/1971 | Coscia et al. |
| 3,556,933 | A | 1/1971 | Williams et al. |
| 3,620,911 | A | 11/1971 | Eklune et al. |
| 3,700,623 | A | 10/1972 | Keim |
| 3,755,220 | A | 8/1973 | Freimark et al. |

(List continued on next page.)

FOREIGN PATENT DOCUMENTS

| | | |
|---|---|---|
| DE | 196 54198 A1 | 6/1998 |
| EP | 0 854 232 | 7/1988 |
| WO | WO95/33885 | 12/1995 |
| WO | WO97/13030 | 4/1997 |
| WO | WO97/15718 | 5/1997 |
| WO | WO97/16593 | 5/1997 |
| WO | WO97/43483 | 11/1997 |

OTHER PUBLICATIONS

"Chemical Systems Boost Dry Content", PPI, Feb. , 1989, p. 41.

(List continued on next page.)

*Primary Examiner*—Jose A. Fortuna
(74) *Attorney, Agent, or Firm*—Finnegan, Henderson, Farabow, Garrett & Dunner LLP

(57) ABSTRACT

The present invention is a method for maximizing water removal from an absorbent web in a press nip. The present invention uses a pressing unit having a blanket with a void volume and with a pressure profile that maximizes water removal in the press section or on the Yankee dryer of a paper machine. The pressure profile of the pressing unit according to the present invention has a very steep pressure drop at and/or following the exit of a pressure distribution curve in order to maximize water removal by minimizing rewet of the web. The improved pressure profile according to the present invention results in increased water removal and/or improved line speed. The void volume further increases water removal and/or improves line speed.

45 Claims, 15 Drawing Sheets

SHOE PRESS WITH LARGE DIAMETER TRANSFER CYLINDER AND WITH FELT PARTIALLY WRAPING CYLINDER

U.S. PATENT DOCUMENTS

| | | | | | |
|---|---|---|---|---|---|
| 3,772,076 | A | | 11/1973 | Keim | |
| 3,812,000 | A | | 5/1974 | Salvucci, Jr. et al. | |
| 3,819,470 | A | | 6/1974 | Shaw et al. | |
| 3,821,068 | A | | 6/1974 | Shaw | |
| 3,858,623 | A | | 1/1975 | Lefkowitz | |
| 3,905,863 | A | | 9/1975 | Ayers | |
| 3,926,716 | A | | 12/1975 | Bates | |
| 3,974,025 | A | | 8/1976 | Ayers | |
| 3,981,084 | A | * | 9/1976 | Sobota | 162/290 |
| 3,994,771 | A | | 11/1976 | Morgan, Jr. et al. | |
| 4,041,989 | A | | 8/1977 | Johansson et al. | |
| 4,064,213 | A | | 12/1977 | Lazorisak et al. | |
| 4,071,050 | A | | 1/1978 | Codorniu | |
| 4,094,718 | A | | 6/1978 | Czerwin | |
| 4,112,982 | A | | 9/1978 | Bugge et al. | |
| 4,149,571 | A | | 4/1979 | Burroughs | |
| 4,157,276 | A | | 6/1979 | Wandel et al. | |
| 4,161,195 | A | | 7/1979 | Khan | |
| 4,182,381 | A | | 1/1980 | Gisbourne | |
| 4,184,519 | A | | 1/1980 | McDonald et al. | |
| 4,191,609 | A | | 3/1980 | Trokhan | |
| 4,204,504 | A | | 5/1980 | Dabrio | |
| 4,239,065 | A | | 12/1980 | Trokhan | |
| 4,300,981 | A | | 11/1981 | Carstens | |
| 4,304,625 | A | | 12/1981 | Grube et al. | |
| 4,309,246 | A | * | 1/1982 | Hulit et al. | 162/113 |
| 4,314,589 | A | | 2/1982 | Buchanan et al. | |
| 4,324,613 | A | | 4/1982 | Wahren | |
| 4,359,069 | A | | 11/1982 | Hahn | |
| 4,376,455 | A | | 3/1983 | Hahn | |
| 4,379,735 | A | | 4/1983 | MacBean | |
| 4,431,481 | A | | 2/1984 | Drach et al. | |
| 4,440,597 | A | | 4/1984 | Wells et al. | |
| 4,440,898 | A | | 4/1984 | Pomplun et al. | |
| 4,456,573 | A | | 6/1984 | Ragazzini et al. | |
| 4,482,601 | A | * | 11/1984 | Hartigan, Jr. | 28/107 |
| 4,496,429 | A | * | 1/1985 | Salminen et al. | 100/118 |
| 4,501,640 | A | | 2/1985 | Soerens | |
| 4,514,345 | A | | 4/1985 | Johnson et al. | |
| 4,528,316 | A | | 7/1985 | Soerens | |
| 4,528,339 | A | | 7/1985 | Coleman, III et al. | |
| 4,529,480 | A | | 7/1985 | Trokhan | |
| 4,533,457 | A | | 8/1985 | Watanabe | |
| 4,564,052 | A | | 1/1986 | Borel | |
| 4,568,423 | A | | 2/1986 | Laapotti | |
| 4,576,682 | A | | 3/1986 | Laapotti | |
| 4,586,984 | A | | 5/1986 | Laapotti | |
| 4,592,395 | A | | 6/1986 | Borel | |
| 4,605,585 | A | | 8/1986 | Johansson | |
| 4,611,639 | A | | 9/1986 | Bugge | |
| 4,625,376 | A | | 12/1986 | Schiel et al. | |
| 4,637,859 | A | | 1/1987 | Trokhan | |
| 4,640,741 | A | | 2/1987 | Tsuneo | |
| 4,673,461 | A | | 6/1987 | Roerig et al. | |
| 4,684,439 | A | | 8/1987 | Soerens | |
| 4,709,732 | A | | 12/1987 | Kinnunen | |
| 4,713,147 | A | | 12/1987 | Saarinen | |
| 4,720,383 | A | | 1/1988 | Drach et al. | |
| 4,759,391 | A | | 7/1988 | Waldvogel et al. | |
| 4,759,976 | A | | 7/1988 | Dutt | |
| 4,788,243 | A | | 11/1988 | Soerens | |
| 4,788,779 | A | | 12/1988 | Sparkes | |
| 4,883,564 | A | | 11/1989 | Chen et al. | |
| 4,886,579 | A | | 12/1989 | Clark et al. | |
| 4,917,767 | A | | 4/1990 | Ilmarinen et al. | |
| 4,917,768 | A | | 4/1990 | Ilmarinen | |
| 4,931,142 | A | | 6/1990 | Steiner et al. | |
| 4,942,077 | A | | 7/1990 | Wendt et al. | |
| 4,973,384 | A | | 11/1990 | Crouse et al. | |
| 4,973,512 | A | | 11/1990 | Stanley et al. | |
| 4,976,085 | A | | 12/1990 | Krueger | |
| 4,976,820 | A | | 12/1990 | Laapotti | |
| 4,976,821 | A | | 12/1990 | Laapotti | |
| 4,978,428 | A | * | 12/1990 | Cronin et al. | 162/358.4 |
| 4,998,568 | A | | 3/1991 | Vohringer | |
| 5,016,678 | A | | 5/1991 | Borel et al. | |
| 5,023,132 | A | | 6/1991 | Stanley et al. | |
| 5,025,046 | A | | 6/1991 | Soerens | |
| 5,043,046 | A | | 8/1991 | Laapotti | |
| 5,054,525 | A | | 10/1991 | Vohringer | |
| 5,066,532 | A | | 11/1991 | Gaisser | |
| 5,071,513 | A | | 12/1991 | Bluhm et al. | |
| 5,074,019 | A | | 12/1991 | Link | |
| 5,084,137 | A | | 1/1992 | Ilmarinen et al. | |
| 5,087,324 | A | | 2/1992 | Awofeso et al. | |
| 5,092,962 | A | | 3/1992 | Koski | |
| 5,098,519 | A | | 3/1992 | Ramasubramanian | |
| 5,098,523 | A | | 3/1992 | Ilmarinen et al. | |
| 5,101,574 | A | | 4/1992 | Orloff et al. | |
| 5,103,874 | A | | 4/1992 | Lee | |
| 5,110,417 | A | | 5/1992 | Lehtonen et al. | |
| 5,114,777 | A | | 5/1992 | Gaisser | |
| 5,118,557 | A | * | 6/1992 | Barnewall | 139/383 A |
| 5,141,601 | A | | 8/1992 | Karisson et al. | |
| 5,164,047 | A | | 11/1992 | Koski | |
| 5,167,261 | A | | 12/1992 | Lee | |
| 5,167,768 | A | | 12/1992 | Cronin et al. | |
| 5,171,389 | A | * | 12/1992 | Stigberg | 156/165 |
| 5,182,164 | A | | 1/1993 | Eklund et al. | |
| 5,199,467 | A | | 4/1993 | Lee | |
| 5,211,815 | A | | 5/1993 | Ramasubramanian | |
| 5,219,004 | A | | 6/1993 | Chiu | |
| 5,223,096 | A | | 6/1993 | Phan et al. | |
| 5,225,269 | A | | 7/1993 | Bohlin | |
| 5,245,025 | A | | 9/1993 | Trokhan et al. | |
| 5,246,544 | A | | 9/1993 | Hollenberg et al. | |
| 5,260,171 | A | | 11/1993 | Smurkoski et al. | |
| 5,262,007 | A | | 11/1993 | Phan et al. | |
| 5,262,011 | A | | 11/1993 | Ilmarinen | |
| 5,264,082 | A | | 11/1993 | Phan et al. | |
| 5,272,821 | A | | 12/1993 | Orloff et al. | |
| 5,275,799 | A | | 1/1994 | Keijsper et al. | |
| 5,277,761 | A | | 1/1994 | Van Phan et al. | |
| 5,281,307 | A | | 1/1994 | Smigo et al. | |
| 5,302,252 | A | | 4/1994 | Götz | |
| 5,312,522 | A | | 5/1994 | Van Phan et al. | |
| 5,320,710 | A | | 6/1994 | Reeves et al. | |
| 5,326,434 | A | | 7/1994 | Carevic et al. | |
| 5,327,661 | A | | 7/1994 | Orloff | |
| 5,328,565 | A | | 7/1994 | Rasch et al. | |
| 5,328,569 | A | | 7/1994 | Cronin | |
| 5,334,289 | A | | 8/1994 | Trokhan et al. | |
| 5,348,620 | A | | 9/1994 | Hermans et al. | |
| 5,353,521 | A | | 10/1994 | Orloff | |
| 5,355,593 | A | | 10/1994 | Kotitschke | |
| 5,364,504 | A | | 11/1994 | Smurkoski et al. | |
| 5,368,696 | A | | 11/1994 | Cunnane, III et al. | |
| 5,372,876 | A | | 12/1994 | Johnson et al. | |
| 5,374,334 | A | | 12/1994 | Sommese et al. | |
| 5,379,808 | A | | 1/1995 | Chiu | |
| 5,382,323 | A | | 1/1995 | Furman, Jr. et al. | |
| 5,389,205 | A | | 2/1995 | Pajula et al. | |
| 5,393,384 | A | | 2/1995 | Steiner et al. | |
| 5,415,737 | A | | 5/1995 | Phan et al. | |
| 5,423,949 | A | | 6/1995 | Ilmarinen | |
| 5,429,686 | A | | 7/1995 | Chiu et al. | |
| 5,431,785 | A | | 7/1995 | Bubik et al. | |
| 5,431,787 | A | | 7/1995 | Braun et al. | |
| 5,456,293 | A | | 10/1995 | Ostermayer et al. | |
| 5,496,442 | A | | 3/1996 | Laapotti | |
| 5,500,092 | A | | 3/1996 | Schiel | |

| | | | | | |
|---|---|---|---|---|---|
| 5,507,223 | A | | 4/1996 | Vallius | |
| 5,547,547 | A | | 8/1996 | Bengtsson | |
| 5,552,959 | A | | 9/1996 | Penniman et al. | |
| 5,556,511 | A | | 9/1996 | Bluhm et al. | |
| 5,569,358 | A | | 10/1996 | Cameron | |
| 5,582,689 | A | | 12/1996 | Van Haag et al. | |
| 5,591,305 | A | | 1/1997 | Cameron | |
| 5,609,726 | A | | 3/1997 | Sollinger | |
| 5,611,893 | A | | 3/1997 | Pajula et al. | |
| 5,618,612 | A | | 4/1997 | Gstrein | |
| 5,620,566 | A | | 4/1997 | Holopainen | |
| 5,639,351 | A | | 6/1997 | Ilmarinen | |
| 5,645,691 | A | | 7/1997 | Zuefle et al. | |
| 5,650,049 | A | | 7/1997 | Kivimaa et al. | |
| 5,657,797 | A | | 8/1997 | Townley et al. | |
| 5,670,023 | A | | 9/1997 | Steiner et al. | |
| 5,688,375 | A | | 11/1997 | Schiel | |
| 5,693,186 | A | | 12/1997 | Vallius | |
| 5,732,876 | A | | 3/1998 | Bradford | |
| 5,776,307 | A | | 7/1998 | Ampulski et al. | |
| 5,795,440 | A | | 8/1998 | Ampulski et al. | |
| 5,804,036 | A | * | 9/1998 | Phan et al. | 162/109 |
| 5,855,739 | A | | 1/1999 | Ampulski et al. | |
| 5,861,082 | A | | 1/1999 | Ampulski et al. | |
| 5,897,745 | A | | 4/1999 | Ampulski et al. | |
| 5,904,811 | A | | 5/1999 | Ampulski et al. | |
| 6,171,446 | B1 | * | 1/2001 | Diaz-Kotti | 162/358.2 |
| 6,174,825 | B1 | * | 1/2001 | Dutt | 162/358.4 |

OTHER PUBLICATIONS

Busker in Tappi, vol. 54, No. 3, p. 373 (1971).

Egan, J. Am Oil Chemists Soc., vol. 55 (1978) pp. 118–121.

D. Lange and M. Radtke, Papermaker, Jul. 1996, p. 16.

Nissan in Tappi, vol. 37, No. 12, p. 597 (1954).

Trivedi et al., J. Am Oil Chemists Soc., (Jun. 1981) pp. 754–756.

Sweet, J.S. Pulp & Paper Mag. Can., 62, No. 7: T367 (1961).

Cellulose Chemistry and Technology, Westfelt, vol. 13, p. 813, (1979).

Helier, M. MacGregor, W. Bliesner, Paper Technology & Industry, p. 154, Jun. 1975.

J. Kinnumnen and A. Kiviranta, Paperi Ja Puu–Paper and Timber, vol. 74, No. 4, (1992), p. 314.

Evans, Chemistry & Industry, Jul. 5, 1969, pp. 893–903.

"Modern Technologies in Pressing & Drying" by J. Blackledge in the 2$^{nd}$ International Pira Conf., Nov. 6–8, 1990 p. 1.

Chapter 2 of *Alkaline–Curing Polymeric Amine–Epichlorohydrin by Espy* in Wet Strength Resins and Their Application (L. Chan Editor, 1994).

Michael Kouris, "Dictionary of Paper", 5$^{th}$ Edition, TAPPI Atlanta, Georgia, p. 236.

Schuwerk, "Shoe Presses and Sleeves for Newsprint—Concepts and Initial Operating Experience," *PaperAge*, Dec. 1997, pp. 30–31, 33–34.

Justus et al., "The Vented–Nip Press," *Tappi*, vol. 47, No. 8, Aug. 1964, pp. 493–496.

Aberg, "Shoe Presses, Felts and Belts," *Albany International*, vol. 44, No. 1–3, 1996: (originally published in Das Papier No. 6, 1996).

Schuwerk, "Shoe Press Technology—Improvements in Quality and Output," *Paper Technology*, Shoe Press, Apr. 1999, pp. 35–40.

Roberts, "What Can Beat the Perforated Drum?" *PPI*, Mar., 1999, pp 33–34, 36–37.

Slater et al. "The Albany Ventabelt®—Grooved Belt Technology That Works," *Albany International*, vol. 45, No. 1–4 (originally presented at 84$^{th}$ Annual Meeting of the Technical Section, CPPA, Jan. 26–30, 1998).

Madden et al. "Effective Shoe Press Venting," *TAPPI Proceedings*, 1998 Engineering Conference, pp. 253–265.

* cited by examiner

SIDE VIEW OF WIDE SHOE PRESS

SHOE PRESS WITH LARGE DIAMETER TRANSFER CYLINDER AND WITH FELT PARTIALLY WRAPING CYLINDER

APPARATUS FOR MAXIMIZING WATER REMOVAL IN A PRESS NIP

RELATED CASES

This is a division of application Ser. No. 09/439,610, filed Nov. 12, 1999, CIP of application Ser. No.: 09/191,376, filed Nov. 13, 1998 now U.S. Pat. No. 6,248,210. PCT Application No. US 99/27097 completed, nationalized in Canada, Jul. 10, 2000, Europe, Jun. 29, 2000 and Turkey, Jul. 12, 2000, all of which are incorporated herein by reference.

FIELD OF INVENTION

The invention relates to a method for maximizing water removal from an absorbent paper web in a press nip. More particularly, the present invention relates to the use of a shoe press on the Yankee dryer with a pressure profile that maximizes water removal. Still more particularly, the present invention relates to a method for utilizing a very steep pressure drop at and/or following the exit of a nip curve in order to maximize water removal by minimizing rewet. Finally, the present invention relates to a method for increasing paper machine speed by utilizing a press section that maximizes water removal.

BACKGROUND OF THE INVENTION

In modern society, bath tissue, paper towels, facial tissue, and paper napkins (hereinafter referred to as packaged paper products) have been remarkably successfully consumer products. The success of these paper products stems from the ability of manufacturers to consistently enhance product attributes at lower cost and to meet volume demands on a timely basis. Packaged paper products offer consumers an array of attributes necessary to such jobs as performing the daily tasks of wiping up spills, personal cleansing, and cleaning household goods. For example, paper towels are engineered to be absorbent and strong while wet whereas bath tissue products are expected to be soft to the touch yet strong while in use. Absorbency and softness are inversely related to strength, often making it difficult to obtain the right balance of attributes. Accordingly, significant research and development efforts are routinely expended to enhance the quality of these products while continuing to reduce cost by, for example, improving the production of these products. Although numerous schemes have been developed and patented, the search by R&D departments continues to seek out new and innovative methods for improving these products.

There are numerous methods described in the patent literature for improving the quality of packaged paper products. One of the earliest known methods to enhance the quality of consumer paper products is described in U.S. Pat. No. 3,301,746 by Sanford and Sisson, assigned to Procter and Gamble Corporation, and incorporated herein by reference in its entirety. This patent describes a papermaking scheme for enhancing product quality by avoiding overall web compression and by using a pattern array of densified regions in the xy plane of the sheet to enhance product strength.

Other early methods for improving the quality of packaged paper products are described in U.S. Pat. No. 3,812,000 by Salvucci and Yiannos and U.S. Pat. No. 3,821,068 by Shaw. These patents are assigned to Scott Paper Company, each of which is incorporated herein by reference in its entirety. Shaw discloses a papermaking scheme for producing soft tissue by avoiding mechanical compression until the sheet has been dried to at least 80% solids. Salvucci and Yiannos disclose a technique for producing a soft tissue structure by avoiding mechanical compression of an elastomeric containing fiber furnish until the consistency of the web is at least 80% solids.

Thicker more absorbent structures can be made using a low batting papermaking felt as described in U.S. Pat. No. 4,533,457 by Curran et al., assigned to Scott Paper Company, and incorporated herein by reference in its entirety. U.S. Pat. Nos. 5,591,305 and 5,569,358 by Cameron, assigned to James River Corporation, and incorporated herein by reference in their entirety, disclose a low-batting, high-bulk-generating felt with improved dewatering capabilities.

A more recent method for improving the quality of a through-air-dried sheet is described in U.S. Pat. No. 4,440,597 by Wells and Hensler, assigned to Procter and Gamble Company, and incorporated herein by reference in its entirety. This patent describes a method for increasing the stretch of a paper web by operating the forming section of a paper machine faster than the through air dryer section of the paper machine. As a result of the speed differential, the paper web is inundated into the through air-dryer-fabric leading to enhanced stretch and absorbency properties in the base sheet and resulting product.

Fibers and chemicals can be used to enhance the quality of packaged paper products. For example, U.S. Pat. No. 5,320,710 by Reeves et al., assigned to Fort James Corporation, and incorporated herein by reference in its entirety, describes a new furnish combination extracted from the species Funifera of the genus Hesporaloe in the Agavaceae family. This furnish has fibers which are very long and which have very fine-geometrical attributes known to enhance tissue and towel performance. U.S. Pat. No. 3,755,220 by Freimark and Schaftlein, assigned to Scott Paper Company, and incorporated herein by reference in its entirety, describes a debonding scheme for maintaining wet strength while reducing product dry strength—a method known to enhance the handfeel of towel products.

The use of bulking fibers can improve the quality of the final end product. U.S. Pat. No. 3,434,918 by Bernardin, U.S. Pat. No. 4,204,504 by Lesas et al., U.S. Pat. No. 4,431,481 by Drach et al., U.S. Pat. No. 3,819,470 by Shaw et al., and U.S. Pat. No. 5,087,324 by Awofeso et al. disclose the use of bulking fibers in papermaking webs to improve product attributes like thickness, absorbency, and softness. These aforementioned patents are incorporated herein by reference in their entirety.

U.S. Pat. No. 5,348,620 by Hermans et al., assigned to Kimberly-Clark Worldwide Inc., and incorporated herein by reference discusses a high consistency/high temperature fiber-treatment-process using a disperser to improve product attributes. To improve tissue softness, several approaches are available to the papermaker such as using certain species of hardwood like eucalyptus in stratified webs as disclosed in U.S. Pat. No. 4,300,981 by Carstens and U.S. Pat. No. 3,994,771 by Morgan et al. The last two patents are incorporated herein by reference in their entirety. These aforementioned patents describe just a few of the many methods developed over the last thirty years to enhance the quality of packaged paper products.

There are also numerous schemes for enhancing the productivity of paper machines. For example, gap formers have been developed to enhance sheet drainage ultimately leading to increased machine speed. New developments in Yankee hood design and Yankee cylinder design have allowed improvements in heat transfer coefficients and mass transfer coefficients, ultimately leading to enhanced machine speeds. New developments in forming fabrics, e.g., multi-layer and triple-layer forming fabrics, have resulted in improved drainage, better fabric life, and enhanced fiber support. These factors translate into enhanced machine speed and productivity. Improvements in press felts, e.g. Scapa's SPECTRA™ felt concept of using a soft polyurethane sandwich near the base of the felt or the use of stratified batting, have led to improvements in felt life, reductions in break-in time, and improvements in water removal at wet presses. These improved press-felt developments have ultimately translated into improved machine speed and productivity. Improvements in Yankee creping adhesives have been helpful to enhance blade wear and reduce sheet plugging. Continuos creping doctors have alleviated the need to frequently change doctor blades. The last two aforementioned developments have led to improvements in machine speed, reductions in down time, and reductions in paper waste. In spite of all these advances, methods are sought to enhance productivity.

The present invention improves the efficiency of known water removal methods by adding one or more pressing units to the production paper machine, in place of or in conjunction with a suction pressure roll. "Pressing units" according to the present invention include those units that physically engage a belt or pressing blanket, which contacts the impression fabric or felt upon which the web travels. "Foraminous endless fabric" as defined in accordance with the present invention includes either an impression fabric or felt. "Pressing unit" as defined in accordance with the present invention includes any press members allowing deformation of the pressing blanket/impression fabric and/or felt/web sandwich to result in asymmetric pressure profiles. These pressing units including pressing blankets are generally discussed in the literature as "shoe presses." Pressing units according to the present invention do not include suction pressure rolls since they lead to symmetrical pressure distributions frequently mathematically described by sine or haversine functions.

Shoe presses have been used to increase water removal at wet presses, ultimately leading to increased machine speed for linerboard grades and more recently, newsprint and fine paper grades. The idea of extending the time in a press nip as a means to enhance water removal is not a new idea. Nissan in 1954 published a paper in Tappi, Vol. 37, No. 12, p. 597 (1954) suggesting that the use of extended time in a press nip would enhance the water removal performance of a press. Over twenty-five years, ago Busker published an early paper in Tappi, Vol. 54, No. 3, p. 373 (1971) on the use of extended nip times, as a means to enhance water removal. Beloit Corporation commercialized the first open belt wide shoe press on a linerboard machine in 1980 as described in an article by J. Blackledge presented during the $2^{nd}$ International Pira Conference, entitled 'Modern Technologies in Pressing and Drying', Nov. 6–8, 1990, p. 1. The aforementioned three articles are herein incorporated by reference in their entirety.

FIG. 1 shows a typical closed belt wide shoe press (see FIG. 2 in an article entitled "New Pressing Technologies for Multiply Board" by J. Breiten in $81^{st}$ Annual Meeting, Technical Section, CPPA, p. A137 for a more detailed drawing). A wide shoe press as described in the literature is essentially a controlled crown roll with a flexible shell and a concave shoe hydrodynamically loaded against each other. The belt or blanket is usually a fabric reinforced polyurethane-coated structure that can be grooved or blind drilled for more efficient water removal. The inside of the belt is generally lubricated with oil, which develops a hydrodynamic film as it passes over the shoe and reduces wear/friction in both surfaces. Wide shoe press nips are on average 5 to 10 times longer than conventional roll press nips (generally, 5"–10" versus 1"–2"). Water deflectors (not shown) on the outside surface will dewater the blanket. By utilizing such a wide nip, loads up to 10,000 pli are possible without the risk of damaging blankets and felts or crushing the sheet. The exit side of the shoe features a sharply curved nose designed to pull the sheet directly out of the nip and away from the felt, thus reducing rewet and improving sheet dryness. U.S. Pat. No. 4,931,142 describes certain advantages to this type of take off angle in conjunction with long press nips. Rolls do not normally support the belt loop of the wide shoe press. The loop generally is closed off with special head assemblies for containing the oil.

Numerous schemes for improving the operation of shoe presses have been developed over the years. For example, in U.S. Pat. No. 5,043,046 by Laapotti and assigned to Valmet Corporation, U.S. Pat. No. 4,625,376 by Schiel et al. and assigned to Voith Corporation, and U.S. Pat. No. 4,673,461 by Roerig and assigned to Beloit Corporation, methods are described to enclose the shoe press in order to contain the oil within the unit. The previous three patents are incorporated herein by reference. U.S. Pat. No. 5,167,768 by Cronin and Roerig and assigned to Beloit Corporation and U.S. Pat. No. 5,582,689 by Rolf Van Haag and Hans-Rolf Conard and assigned to Voith Corporation describe methods for varying the pressure distribution in a shoe press. This capability avoids the need to offset the center of loading or reshape the shoe to change the pressure distribution. These last two patents are also incorporated herein by reference. U.S. Pat. No. 5,693,186 by Vallius, assigned to Valmet Corporation, and incorporated herein by reference describes a tension link scheme for containing the loading within the framing of the shoe press apparatus. This scheme ultimately avoids the need to fortify flooring when operating at high line loads. These are just a few of the many developments that have led to improved operating shoe presses.

In the art of pressing linerboard, newsprint, and fine paper webs with a shoe press, a long shoe with a gradual pressure rise is desirable for good dewatering and enhanced bulk properties. This is especially true for flow controlled webs. Linerboard and to a certain extent newsprint and fine paper have flow controlled pressing conditions. Flow controlled pressing conditions occur when the time in the nip becomes an important factor determining the amount of water removed from the web. High pressure can be attained with these long shoes but it requires high line loads. FIG. 2 shows the relationship between peak pressure (i.e., the maximum pressure in the nip) and line load (i.e., the total force divided by linear width) for shoe press nips compiled from an extensive but not exhaustive search of the literature. Table I describes the literature references used to develop FIG. 2.

TABLE I

References Used to Generate FIG. 2.

| Reference Number | Source |
|---|---|
| 1 | U.S. Pat. No. 5,167,768 |
| 2 | W. Schuwerk, Paper Age, September, 1997, p.18. |
| 3 | N. Anderson, Journal of Tappik, Vol. 21, No. 1, 1998, p.52. |
| 4 | J. Kinnunen and A. Kiviranta, Paperi Ja Puu-Paper and Timber Vol. 74, No. 4, 1992, p. 314. |

TABLE I-continued

References Used to Generate FIG. 2.

| Reference Number | Source |
|---|---|
| 5 | J. Kivimaa, M. Laurikainen, and K. Pansu, PITA Water Removal Conference 1997 York, Paper Technology, April, 1998. |
| 6 | J. Blacklege and D. Lange, 2nd International Pira Conference, "Modern Technologies in Pressing and Drying", Nov. 6–8, 1990, p.1. |
| 7 | M. Radtke, 79th Annual Meeting, Technical Section, CPPA, p. A221. |
| 8 | J. Breiten, 81st Annual Meeting, Technical Section, CPPA, p. A137. |
| 9 | E. Tenfalt, J. Wilmenius, and O. Swanberg, Nordic Pulp and Paper Research Journal, 1998, p.16. |
| 10 | D. Lange and M. Radtke, Papermaker, July 1996, p. 16. |
| 11 | "Chemical Systems Boost Dry Content", PPI, February, 1989, p.41. |

The graph in FIG. 2 shows that shoe presses normally operate at high line load conditions, usually greater than 270 kN/m and at high peak pressures. It also shows that shoe presses are not operated at low line loads and at high peak pressures (e.g., crosshatched region in FIG. 2).

In the art of making tissue by the conventional wet pressing operation, Yankee are loaded with suction pressure rolls to remove water from the tissue web and the web to the dryer for further processing by the creping operation. The pressure distribution in the suction pressure roll nip is symmetrical in shape and is described mathematically by a sine or a haversine curve. Suction pressure rolls loaded to a Yankee dryer are routinely run at line loads less than 100 kN/m and at peak pressures of less than 4500 kN/m$^2$. In the lower left-hand corner of FIG. 2 some typical peak pressure versus line load data for suction pressure rolls are shown. The deflection of large, conventional Yankee dryers due to hoop stress levels limits the line load to less than about 100 kN/m. As a result, it is very difficult to attain high peak pressures in the nip at these low line loads, since the pressure distribution cannot be altered. This limitation has extreme consequences for tissue grades since they are pressure controlled, i.e., the flow resistance in the web is low due to the use of high freeness furnishes and low basis weight webs, thus it is believed that peak pressure, not time in the nip, controls press dewatering. These suction pressure rolls suffer from other disadvantages. For example, since the nip diverges after the maximum pressure is achieved, rewet can occur for a large part of the press nip. A typical suction pressure roll curve appears in FIG. 3, where nip divergence is apparent. Also, the suction pressure roll unit is not flexible so that the line load needs to be fixed and matched to a given Yankee crown condition in order to obtain a uniform nip profile across the machine. Furthermore, since the loading cylinders are located at each end of the pressure roll, profiling capabilities are very limited.

The use of conventional shoe presses on a Yankee dryer at the maximum hoop stress limit of 100 kN/m would lead to very low peak pressures as FIGS. 2 and 3 demonstrate. For example, with a 120 mm shoe at 100 kN/m, the typical peak pressure is on the order of 1700 kN/m as FIG. 3 demonstrates. Since the press nip for low weight tissue and towel grades is pressure controlled, the very low peak pressure could cause a decrease in post press dryness, ultimately causing a loss in production. The counter roll in a conventional shoe press is small by comparison to the diameter of a Yankee dryer. As a result, the use of a conventional shoe shape would make it very difficult to remove the felt/fabric from the sheet at the nip exit. Therefore, conventional shoe shapes and conventional felt/fabric takeoff angles would exacerbate rewet for low weight absorbent products.

Currently, there are no commercial uses of shoe press technology in the production of absorbent paper products. U.S. Pat. No. 5,795,440 by Ampulski et al., and U.S. Pat. No. 5,776,307 by Ampulski et al.-both assigned to Procter and Gamble Corporation and both incorporated herein by reference, describe a scheme for making a shaped web by pressing an embryonic web into an imprinting fabric between two felts. These patents use a shoe press assembly in the preparation of a wet pressed paper web. Ampulski et al., like others using pressing units, teaches the use of longer conventional press nips. Ampulski et al. discloses that the nip length is greater than 3.0 inches and may be as long as 20.0 inches. Ampulski et al. achieves this extended nip length through the use of a shoe press. Ampulski et al., like all previous users of shoe presses, fails to consider the use of increased peak pressure.

International patent application WO 97/43483 by Hermans and Friedbaurer, assigned to Kimberly-Clark Worldwide, Inc., and incorporated herein by reference discloses that extended nip presses, while having been successfully used for making paperboard, have not been used to make low density paper products such as tissue because the high pressure and longer dwell times in an extended nip press serve to densify the sheet beyond that experienced by conventional tissue wet pressing methods. Hermans and Friedbaurer overcome the increased density due to extended nip pressing by incorporating modified resilient fibers (e.g., chemically cross-linked cellulosic fibers) in the web and by wet micro-shaping the web. They also disclose shoe lengths typically in the range of 5 to 10 inches. Like Ampulski et al., Hermans and Friedbaurer do not consider critical peak pressures or line loads as important.

U.S. Pat. No. 5,393,384 by Steiner et al., and assigned to J. M. Voith, GmbH (hereinafter "the '384 patent") generally describes the use of a shoe press in the production of a tissue web. The '384 patent describes the use of a shoe press preceding or contacting a Yankee drying cylinder. The shoe press is used in conjunction with an impermeable belt to reduce remoistening of the sheet by the felt.

These authors used the impermeable belt since they state: "the prevailing opinion in selecting suitable drying presses in contingence on the web thickness so far has been that for drying thin webs there are only simple roll presses suited which generate a sufficiently high contact pressure for a short time, thus optimally removing the water from a thin web (tissue web) due to the short path, whereas shoe type presses are suited essentially for drying thick, heavy webs, since they generate a persistent pressure which allows the water sufficient time for the considerable longer path in leaving the web." Critical peak pressure and line loads are not discussed in the disclosure. Since the shoe press described in this disclosure is conventional, a pressure curve for this type of shoe press is most likely similar to the "typical shoe press curve" illustrated in FIG. 3.

Voith, the assignee of the '384 patent, continues to develop the use of a shoe press for the production of paper products. U.S. Pat. No. 5,500,092 by Schiel describes a tissue making machine using a triple press nip where the second nip is a shoe press nip. The criticality of pressure distribution shape and peak pressure/line load magnitudes are not disclosed in the '092 patent. In the September 1997 article W. Schuwerk, "Shoe Presses and Sleeves for Newsprint-Concepts and Initial Operating Experience," PaperAge, Pp. 18–23, Voith described the advantages of their NIPCOFLEX shoe press. According to that article, "[T]o obtain optimum product characteristics, dewatering in the press must [therefore] show as flat a pressure gradient as possible." In fact, the shoe press described in the article refers to the third section of a newsprint paper machine operating at a line loading of 850 kN/m and a peak pressure of ~5.6 MPa, typical of standard conventional shoe designs and well outside the range of the present invention.

U.S. Pat. No. 4,931,142 by Steiner, Muller, Schiel, and Flamig, assigned to Voith Corporation and incorporated herein by reference in its entirety describes a method of eccentrically arranging a press blanket with respect to the press plane. This arrangement enables the blanket upon leaving the press nip to immediately move steeply downward and away from the sheet in order to reduce remoistening of the web. Methods of varying the felt angle with respect to the traveling web in a double felted press nip were disclosed to avoid remoistening the sheet and for quick release of the sheet from the felt. Steiner et al. also discloses that the joint path of travel of the paper web, felt, and blanket can be made substantially shorter than prior art. By utilizing the Steiner et al. invention, the joint travel of the felt, web, and blanket can be made equal to zero, i.e., the web can detach itself from the felt directly at the emergence from the press nip. Steiner et al. does not address low line loads and high peak pressures needed for optimum shoe press performance on Yankee dryers. It also does not disclose the need to taper the press shoe to achieve minimized rewet.

U.S. Pat. No. 5,556,511 by Bluhm and Gotz, assigned to Sulzer-Escher Wyss, and incorporated herein by reference describes a process for making toilet tissue webs whereby a web is wet pressed in a heated pressing arrangement. The heated pressing arrangement can be a shoe press. This disclosure does not address the importance of proper choice of peak pressure, line load, and shoe shape for making absorbent products at high speeds. In fact, the critically of line loads and peak pressures is not discussed. Bluhm and Gotz like all previous users of shoe presses, fails to consider the use of increased peak pressure at low line loads as a means to improve water removal.

U.S. Pat. No. 4,973,384 by Crouse, Pulkowski, and Porter, assigned to Beloit Corporation, and incorporated herein by reference describes a process for using a heated extended nip press for optimizing sheet properties without lamination. To accomplish the aforementioned task Crouse et al. found that by application of pressure for an increased period of time, the increased residence time enables the removal of more water from the formed web. As a result, these authors teach toward the use of a conventional long shoe design. They also found that for a heated extended nip press by "gradually decreasing pressure in machine direction toward the trailing edge of the shoe, rapid flashing of steam from the emerging pressed web was avoided." As a result these authors teach away from the use of a heavy peaked pressure distribution at the exit side of a shoe press nip.

WO 97/16593 by Wedel and Worcester incorporated herein by reference discloses an impulse drying method for tissue structures using a shoe press and an induction heater. This disclosed impulse-drying method is intended to replace the Yankee dryer with its associated problems. These authors list the issues with Yankee dryers as being limited in surface temperature to 185° F., as being limited in line load to 500 pli due to shell thickness limitations, and as being limited in roll diameter. These authors state that shoe length is typically ten inches for the impulse drying unit. The line loads disclosed are 1000 pli to 10,000 pli. As a result, this application teaches away from the combined use of a low line load with a substantial peak pressure.

Contrary to the current state of the art, the present inventors have, quite unexpectedly, found that in the production of absorbent paper products, the use of a steep, sharp pressure gradient and controlled separation when producing absorbent paper can improve dewatering efficiency without adversely affecting product properties. An example of the pressure profile of the new shoe design for absorbent paper production according to the present invention is illustrated in FIG. 3.

The present inventors unexpectedly discovered that good sheet dewatering and appropriate bulk/strength properties for low weight absorbent products could be attained with this pressure optimized shoe press. The optimized pressure conditions can be achieved according to the present invention by shaping the shoe, tilting the shoe in the shoe press, reducing the length of the shoe in the shoe press, and/or tapering the exit side of the shoe. In addition, these conditions can also be achieved by deflecting the pressing blanket from the web carrying foraminous-endless-fabric at a point nearly simultaneous with separation of the foraminous-endless-fabric from the nascent web, thereby reducing rewet. These techniques enable the pressure optimized shoe press according to the present invention to achieve improved dewatering while maintaining bulk with line loads less than about 240 kN/m and peak pressures greater than about 2000 kN/m$^2$.

SUMMARY OF THE INVENTION

Further advantages of the invention will be set forth in part in the description, which follows and in part will be apparent from the description. The advantages of the invention may be realized and attained by means of the instrumentalities and combinations particularly pointed out in the appended claims.

To achieve the foregoing advantages and in accordance with the purpose of the invention, as embodied and broadly described herein, there is disclosed:

An apparatus for forming an absorbent paper sheet product comprising:
- a moving foraminous endless fabric;
- means for depositing a nascent web for the absorbent paper sheet on the foraminous endless fabric;
- a moving endless pressing blanket;
- a Yankee drying cylinder; and
- a pressing unit engaging the pressing blanket adapted to urge the nascent web for the absorbent paper sheet on the foraminous endless fabric into engagement with the Yankee drying cylinder thereby forming a nip, the pressing unit being configured to create a peak engagement pressure of at least about 2000 kN/m$^2$ at an overall line load of less than about 240 kN/m.

There is further disclosed:

An apparatus for forming an absorbent paper sheet product comprising:
- a moving foraminous endless fabric;
- means for depositing a nascent web for the absorbent paper sheet on the foraminous endless fabric;
- a moving endless pressing blanket;
- a Yankee drying cylinder; and
- a pressing unit engaging the pressing blanket adapted to urge the nascent web for the absorbent paper sheet on the foraminous endless fabric into engagement with the Yankee drying cylinder thereby forming a nip, the pressing unit being configured to create a peak engagement pressure of at least about 2000 kN/m$^2$ at an overall line load of less than about 240 kN/m, the pressing unit being configured to disengage the web from the foraminous endless fabric such that rewet of the nascent web by the foraminous endless fabric is less than about 50% of the rewet predicted by the Sweet equations based upon the properties of the foraminous endless fabric and the nascent web.

There is still further disclosed:

An apparatus for forming an absorbent paper sheet product comprising:

a moving foraminous endless fabric;

means for depositing a nascent web for the absorbent paper sheet on the foraminous endless fabric;

a moving endless pressing blanket;

a Yankee drying cylinder; and a pressing unit engaging the pressing blanket adapted to urge the nascent web for the absorbent paper sheet on the foraminous endless fabric into engagement with the Yankee drying cylinder thereby forming a nip, the pressing unit being configured to create a peak engagement pressure of at least about 2000 kN/m$^2$ at an overall line load of less than about 240 kN/m, the pressing unit being configured to both disengage the web from the foraminous endless fabric and disengage the foraminous endless fabric from the pressing blanket at a nip length of less than about one inch from the point the nip pressure reaches zero.

There is still further disclosed:

An apparatus for forming an absorbent paper sheet product comprising:

a moving foraminous endless fabric;

means for depositing a nascent web for the absorbent paper sheet on the foraminous endless fabric;

a moving endless pressing blanket;

a transfer cylinder; and a pressing unit engaging the pressing blanket adapted to urge the nascent web for the absorbent paper sheet on the foraminous endless fabric into engagement with the transfer cylinder thereby forming a nip, the pressing unit being configured to create a peak engagement pressure of at least about 2000 kN/m$^2$ at an overall line load of less than about 240 kN/m.

There is still further disclosed:

An apparatus for forming an absorbent paper sheet product comprising:

a moving foraminous endless fabric;

means for depositing a nascent web for the absorbent paper sheet on the foraminous endless fabric;

a moving endless pressing blanket;

a transfer cylinder; and a pressing unit engaging the pressing blanket adapted to urge the nascent web for the absorbent paper sheet on the foraminous endless fabric into engagement with the transfer cylinder thereby forming a nip, the pressing unit being configured to create a peak engagement pressure of at least about 2000 kN/m$^2$.

There is still further disclosed:

An apparatus for forming an absorbent paper sheet product comprising:

a moving foraminous endless fabric;

means for depositing a nascent web for the absorbent paper sheet on the foraminous endless fabric;

a moving endless pressing blanket;

a backing roll; and a pressing unit engaging the pressing blanket adapted to urge the nascent web for the absorbent paper sheet on the foraminous endless fabric into engagement with the backing roll thereby forming a nip, the pressing unit being configured to create a peak engagement pressure of at least about 2000 kN/m$^2$ at an overall line load of less than about 240 kN/m.

There is still further disclosed:

A method of making an absorbent paper sheet product comprising:

depositing a nascent web for the absorbent paper sheet product on a moving foraminous endless fabric; and contacting the moving foraminous endless fabric bearing the deposited nascent web with a moving endless pressing blanket engaged with a pressing unit thereby forming a nip, the pressing unit being configured to create a peak engagement pressure of at least about 2000 kN/m$^2$ at an overall line load of less than about 240 kN/m.

There is also disclosed:

A method of making an absorbent paper sheet product comprising:

depositing a nascent web for the absorbent paper sheet product on a moving foraminous endless fabric;

contacting the moving foraminous endless fabric bearing the deposited nascent web with a moving endless pressing blanket engaged with a pressing unit thereby forming a nip, the pressing unit being configured to create a peak engagement pressure of at least about 2000 kN/m$^2$ at an overall line load of less than about 240 kN/m;

transferring the web to a Yankee drying cylinder; and creping the web from the Yankee drying cylinder.

There is finally disclosed:

A method of making an absorbent paper sheet product comprising:

depositing a nascent web for the absorbent paper sheet product on a moving foraminous endless fabric;

contacting the moving foraminous endless fabric bearing the deposited nascent web with a shoe press thereby forming a nip between the shoe press and a Yankee drying cylinder, the shoe press being configured to create a peak engagement pressure of at least about 2000 kN/m$^2$ at an overall line load of less than about 240 kN/m;

disengaging the web from the foraminous endless fabric in the nip onto a Yankee drying cylinder;

drying the web on the Yankee drying cylinder; and creping the web from the Yankee drying cylinder.

The accompanying drawings are included to provide a further understanding of the invention and are incorporated in and constitute a part of the specification. The drawings illustrate embodiments of the invention and, together with the description, serve to explain the principles of the invention.

DETAILED DESCRIPTION

In the production of absorbent paper products, paper web drying efficiency and paper web moisture removal directly affect machine speed, and therefore have a significant effect on the productivity that can be attained on a papermachine. The present invention improves paper web moisture removal through the controlled use of a pressing unit in conjunction with a backing roll and/or a transfer cylinder or Yankee drying cylinder. An absorbent paper web as defined herein includes bath tissue, paper towels, paper napkins, wipers, and facial tissue. The basis weight of such products and their base sheets are in the range of about 8 lb/3000 $ft^2$ to about 50 lb/3000 $ft^2$.

Figure 4:
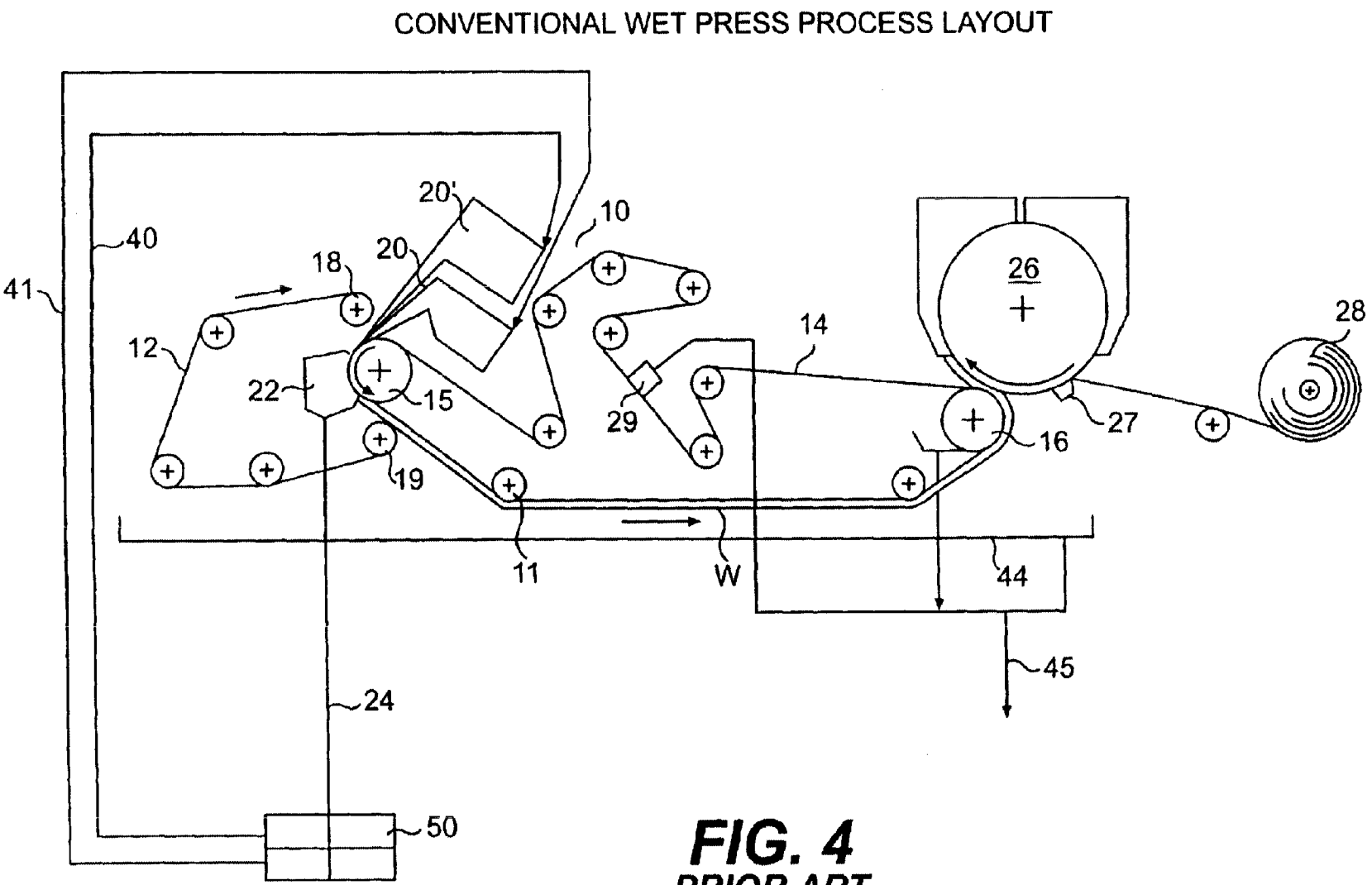
FIG. 4 PRIOR ART
FIG. 4 illustrates one conventional wet press processing apparatus.

According to the present invention, absorbent paper may be produced using any known method or papermaking scheme. The most common papermaking methods are (I) conventional wet pressing (CWP) and (II) through-air-drying (TAD). In a conventional wet press process, i.e., apparatus (10), as exemplified in FIG. 4, a furnish is fed by means not shown through conduits (40, 41) to headbox chambers (20, 20'). A web (W) is formed on a conventional wire former on fabric (12), supported by rolls (18, 19), from a liquid slurry of pulp, water and other chemicals. Materials removed from the web through fabric (12) in the forming zone are returned to silo (50), from saveall (22) through conduit (24). The web is then transferred to a moving felt (14), supported by roll (11) for pressing and drying. Materials removed from the web during pressing or from the Uhle box (29) are collected in saveall (44) and fed to white water conduit (45). The web is pressed by suction pressure roll (16) against the surface of a rotating Yankee dryer cylinder (26), which is heated to cause the paper to substantially dry on the cylinder surface. The moisture within the web as it is laid on the Yankee surface causes the web to transfer to the surface. Liquid adhesive may be applied to the surface of the dryer to provide substantial adherence of the web to the creping surface. The web is then creped from the surface with a creping blade (27). The creped web is then usually passed between calender rollers (not shown) and rolled up on reel (28) prior to further converting operations, for example, embossing.

A web may alternatively be subjected to vacuum deformation on an impression fabric, alone or in conjunction with other physical deformation processes, and a dewatering step which removes water from the web to a solids content of at least about 30% without the need for overall physical compression. This type of process is conventionally referred to as a through-air-drying process or TAD process. This process is generally described in U.S. Pat. Nos. 3,301,746 to Sanford et al. and 3,905,863 to Ayers, which are incorporated herein by reference in their entirety.

Figure 5:
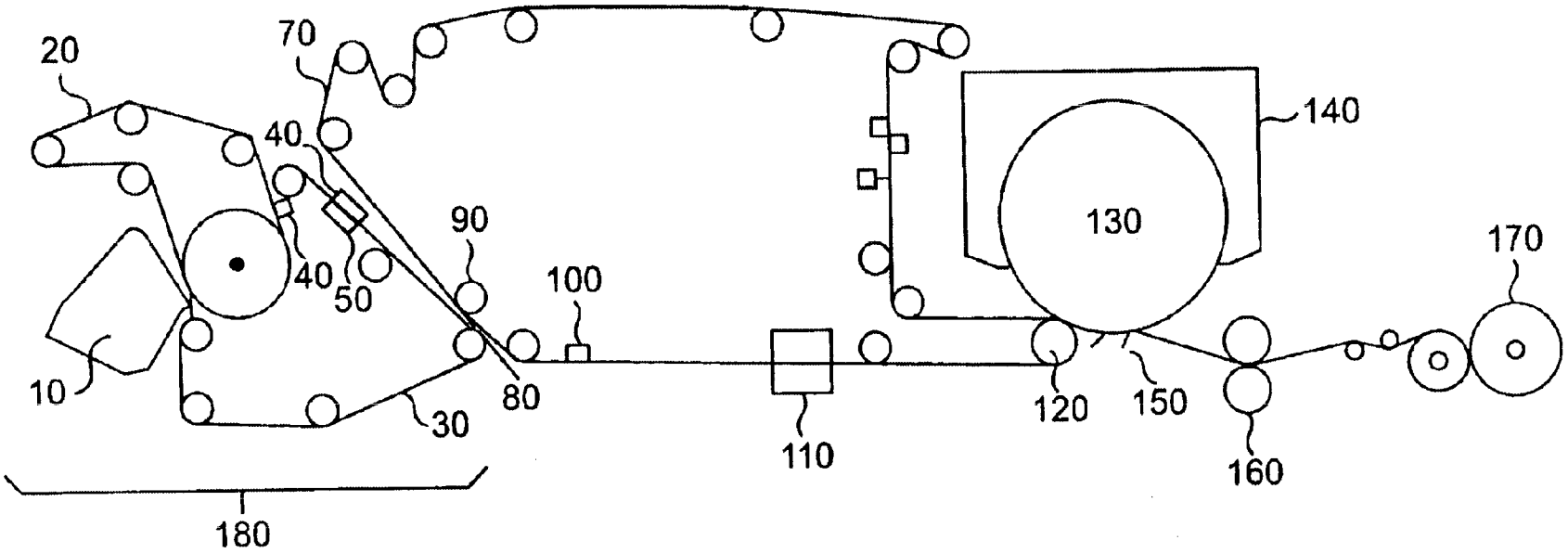
FIG. 5 PRIOR ART
FIG. 5 illustrates one conventional through-air-drying processing apparatus.

As an example, one conventional TAD process is illustrated in FIG. 5. In this process, fibers are fed from a headbox (10) to a converging set of forming wires (20, 30). In this twin wire forming arrangement water is removed from the web by centrifugal forces and by vacuum means. The wet nascent web is cleanly transferred to forming wire (30) via Uhle box (40). The web can be optionally processed to remove water by vacuum box (50) and steam shroud (60). The web is carried along forming fabric (30) until it is transferred to a TAD fabric (70) at junction (80) by means of a vacuum pickup shoe (90). The web is further dewatered at dewatering box (100) to increase web solids. Besides removing water from the web, vacuum pickup shoe (90) and dewatering box (100) inundate the web into TAD fabric (70) causing bulk and absorbency improvements.

Further enhancements in bulk and absorbency can be obtained by operating the speed of the forming section (i.e., the speeds of forming fabrics 20 and 30) faster than the speed of TAD fabric (70). This is referred to as fabric/fabric creping. In this manner the web is inundated and wet shaped into the fabric creating bulk and absorbency. Thickness created by wet shaping is more effective in generating absorbency (i.e. less structural collapse) than thickness created in the dry state, e.g., by conventional embossing. The web is then carried on TAD fabric (70) to drying unit (110) where heated air is passed through both the web and the fabric to increase the solids content of the web. Generally, the web is 30 to 95% dry after exiting drying unit (110). In one process, the web may be removed directly from TAD fabric (70) in an uncreped state. In the embodiment shown in FIG. 5, the web is transferred from TAD fabric (70) to Yankee dryer cylinder (130) and is creped from dryer cylinder (130) via creping blade (150). The creped web is then usually passed between calender rollers (160) and rolled up on reel (170) prior to further converting operations, for example, embossing to make roll products.

According to the present invention, an absorbent paper web can be made by dispersing fibers into aqueous slurry and depositing the aqueous slurry onto the forming wire of a paper making machine. Any art recognized forming scheme might be used. For example, an extensive but non-exhaustive list includes a crescent former, a C-wrap twin wire former, an S-wrap twin wire former, a suction breast roll former, a fourdrinier former, or any art recognized forming configuration. The particular forming apparatus is not critical to the success of the present invention. The forming fabric can be any art recognized foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982;

4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,467; 5,211,815; 5,219,004; 5,245,025; 5,277,761; 5,328,565; and 5,379,808 all of which are incorporated herein by reference in their entirety. The particular forming fabric is not critical to the success of the present invention. One forming fabric found particularly useful with the present invention is Appleton Mills Forming Fabric 2184 made by Appleton Mills Forming Fabric Corporation, Florence, Miss.

Papermaking fibers used to form the absorbent products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fiber sources in different percentages, can be used in the present invention. Suitable fibers are disclosed in U.S. Pat. Nos., 5,320,710 and 3,620,911, both of which are incorporated herein by reference.

Papermaking fibers can be liberated from their source material by any one of the number of chemical pulping processes familiar to one experienced in the art including sulfate, sulfite, polysulfide, soda pulping, etc. The pulp can be bleached if desired by chemical means including the use of chlorine, chlorine dioxide, oxygen, etc.

Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

The suspension of fibers or furnish may contain chemical additives to alter the physical properties of the paper produced. These chemistries are well understood by the skilled artisan and may be used in any known combination.

The pulp can be mixed with strength adjusting agents such as wet strength agents, dry strength agents and debonders/softeners. Suitable wet strength agents will be readily apparent to the skilled artisan. A comprehensive but non-exhaustive list of useful wet strength aids include urea-formaldehyde resins, melamine formaldehyde resins, glyoxylated polyacrylamide resins, polyamide-epichlorhydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the tradename of PAREZ 631NC by Cytec Industries. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorhydrin resins, an example of which is sold under the tradenames Kymene 557LX and Kymene 557H by Hercules Incorporated of Wilmington, Del. and CASCAMID® from Borden Chemical Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline—Curing Polymeric Amine-Epichlorohydrin* by Espy in *Wet—Strength Resins and Their Application* (L. Chan, Editor, 1994), herein incorporated by reference in its entirety. A reasonably comprehensive list of wet strength resins is described by Westfelt in *Cellulose Chemistry and Technology*, Volume 13, p. 813, 1979, which is incorporated herein by reference. The pulp, when making towel grades according to the present invention, preferably contains up to about 30 lbs/ton, more preferably from 10 to 20 lbs/ton of wet strength aids. Wet strength resins are not normally added to tissue grades.

Suitable dry strength agents will be readily apparent to one skilled in the art. A comprehensive but non-exhaustive list of useful dry strength aids includes starch, guar gum, polyacrylamides, carboxymethyl cellulose and the like. Of particular utility is carboxymethyl cellulose, an example of which is sold under the tradename Hercules CMC by Hercules Incorporated of Wilmington, Del. The pulp preferably contains from 0 to 10 lbs/ton, more preferably from 1 to 5 lbs/ton of dry strength aid.

Suitable debonders will be readily apparent to the skilled artisan. Debonders or softeners may also be incorporated into the pulp or sprayed upon the web after its formation. The pulp preferably contains from 0 to 10 lbs/ton, more preferably from 1 to 5 lbs/ton of debonder/softener.

The present invention may be used with a particular class of softener materials-amido amine salts derived from partially acid neutralized amines. Such materials are disclosed in U.S. Pat. No. 4,720,383. Evans, Chemistry and Industry, Jul. 5, 1969, Pp. 893–903; Egan, *J. Am. Oil Chemist's Soc.*, Vol. 55 (1978), Pp. 118–121; and Trivedi et al., *J. Am. Oil Chemist's Soc.*, Jun. 1981, Pp. 754–756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these material are quaternary ammonium compounds, the compositions as a whole are pH-sensitive. Therefore, in the practice of the present invention with this class of chemicals, the pH in the headbox should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. These compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The fibrous web is then either deposited on an impression drying fabric, in the case of the TAD process or on a dewatering felt for the CWP process. Any art recognized fabrics or felts could be used with the present invention. For example, a non-exhaustive list of impression fabrics would include plain weave fabrics described in U.S. Pat. No. 3,301,746; semitwill fabrics described in U.S. Pat. Nos. 3,974,025 and 3,905,863; bilaterally-staggered-wicker-basket-cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480, 4,637,859, 4,514,345, 4,528,339, 5,364,504, 5,334,289, 5,275,799, and 5,260,171; and fabrics containing diagonal pockets described in U.S. Pat. No. 5,456,293. The aforementioned patents are incorporated herein by reference, in their entirety. Any art-recognized-felt can be used with the present invention. For example, felts can have double-layer base weaves, triple-layer base weaves, or laminated base weaves. Preferred felts according to the present invention are those having the laminated base weave design. A wet-press-felt found particularly useful with the present invention is AMFlex 3 made by Appleton Mills Corporation. Non-exhaustive background art in the press felt area includes U.S. Pat. Nos. 5,657,797; 5,368,696; 4,973,512; 5,023,132; 5,225,269; 5,182,164; 5,372,876; and 5,618,612 all-of-which are incorporated herein by reference in their entirety. After the web made by the conventional wet press process has reached a solids content of about 15%, more preferably about 20%, the web/foraminous fabric sandwich is contacted with a pressing blanket engaged with a pressing unit, one embodiment in the art referred to as a shoe press. In a similar web made by through air drying, the web/foraminous fabric sandwich is preferably contacted with the pressing blanket engaged with a pressing unit after the web has reached a solids content of at least about 20%, more preferably at least about 25%.

The pressing unit including a pressing blanket according to the present invention can have any art-recognized configuration. The nip can be created between the pressing unit and a backing roll, in the case of a stand-alone pressing unit, or can be created between the pressing unit and a transfer cylinder. As used in the present invention, backing roll refers to a roll that contacts the web but does not remove the fibrous web from the carrier fabric or felt. Backing rolls for use according to the present invention may be heated or cold. The backing roll can be made of hard rubber or metal. When the rolls are heated with an induction heater the roll is preferably constructed or coated with high diffusivity material, such as copper, to aid in increasing heat transfer.

As used in the present invention, transfer cylinder refers to a roll that picks up the fibrous web thereby transferring the fibrous web from the foraminous carrier fabric upon which it had been carried. Typical transfer cylinders according to the present invention can include a steel roll, a metal coated roll, a granite roll, a Yankee drying cylinder, and a gas fired drying cylinder. Transfer cylinders for use according to the present method may be heated or cold. When the transfer cylinder is heated with an induction heater the cylinder is preferably constructed or coated with high diffusivity material, such as copper, to aid in increasing heat transfer. One or more transfer cylinders may be used in the process according to the present invention.

Heat is preferably applied to the transfer cylinder and/or backing roll. Heat can be applied by any art-known scheme including induction heating, oil heating and steam heating. Commercial available induction heaters can generate very high energy-transfer rates. An induction heater induces electrical current to the conducting roll surface. Since the induced current can be quite large, this factor produces a substantial amount of resistive heating in the conducting roll. Backing roll or transfer cylinder temperature can be anywhere from ambient to 700° F. but are more preferably from 180° F. to 500° F. Preferred heating schemes according to the present invention are induction heating and steam-heating.

Increased temperature in the backing roll or transfer cylinder decreases the viscosity of the water and makes the sheet more deformable hence improving water removal. Also, increased temperature and operating pressure bring the sheet into intimate contact with the transfer cylinder or backing roll, which improves heat transfer to the web. Furthermore, high steam pressure in the web within the nip can aid in rapidly displacing water from the sheet to the felt.

The pressing unit including a pressing blanket according to the present invention is preferably a shoe press. A shoe press includes a shoe element(s), which is pressed against the backing roll or transfer cylinder. The shoe element is loaded hydrodynamically against the backing roll or transfer cylinder causing a nip to be formed. A pressing belt or blanket traverses the shoe press nip with the fibrous web in contact with the foraminous fabric.

Pressing blankets can be smooth, or to enhance water removal at the press they can be grooved or blind drilled. Conventional pressing blanket designs contain a fabric coated with polyurethane where the fabric is used as reinforcement. Other pressing blanket designs use yarns embedded in the polyurethane to provide reinforcement. One preferred pressing blanket according to the present invention is a yarn reinforced blanket design under the tradename QualiFlex B, which is supplied by Voith Sulzer Corporation.

The shoe element length can be less than about 7 inches but is more preferably less than about 3 inches for the present invention. According to the present invention the shoe element will also be referred to as a hydraulic engagement member. Shoe designs can be hydrodynamic, hydrodynamic pocket, or hydrostatic. In the hydrodynamic shoe design, the oil lubricant forms a wedge at the ingoing side of the nip ultimately causing the formation of a thin oil film that protects the blanket and the shoe. The hydrodynamic pocket design incorporates a machined full width pocket in the shoe used for emptying the oil in the pressurized zone of the shoe. The final design is the hydrostatic design where oil is fed into the center region of the shoe. The preferred shoe design according to the present invention is hydrodynamic.

Shoe presses for use according to the present invention can be open or closed. Early shoe press designs were the open belt configurations where an impermeable pressing blanket encircled a series of rollers similar to that of a fabric or felt run. These open designs suffered from papermachine system contamination by oil. The oil loss was at one time, up to 20 liters per day on some systems. The open shoe design is also inferior to a closed design since it cannot be operated in the inverted mode. The closed shoe design alleviates the oil contamination issue and is therefore preferred for use in the present invention.

According to one embodiment of the present invention, the peak pressure in the shoe press is preferably greater than about 2000 kN/m$^2$, with a line load of preferably less than about 240 kN/m. In another embodiment of the present invention, for conventionally made wide-Yankee-dryers the peak pressure is preferably greater than about 2000 kN/m$^2$, while the line load is preferably less than about 175 kN/m and more preferably less than about 100 kN/m. For the purposes of the present invention, kN/m is an abbreviation for kilonewtons per meter and kN/m$^2$ is an abbreviation for kilonewtons per square meter.

The sheet can be creped from the transfer cylinder by any art-recognized methods using any art recognized creping aid.

The maximum line load a current standard Yankee can sustain is on the order of 100 kN/m. When a Yankee is used in conjunction with a suction pressure roll, the Yankee needs to be precisely crowned at the prevailing load to obtain a uniform nip.

This procedure is necessary due to the inflexibility of the suction pressure roll arrangement and also due to loading at only the ends of the suction pressure roll. For the case of a shoe press, loading occurs at multiple points across the cross machine direction; individual shoe elements can be installed across the machine to give more precise cross machine direction pressing flexibility; and the shoe press is flexible and capable of conforming to the Yankee dryer surface. As a result, the precision to which the Yankee is ground for crowning will be less.

Figure 6:
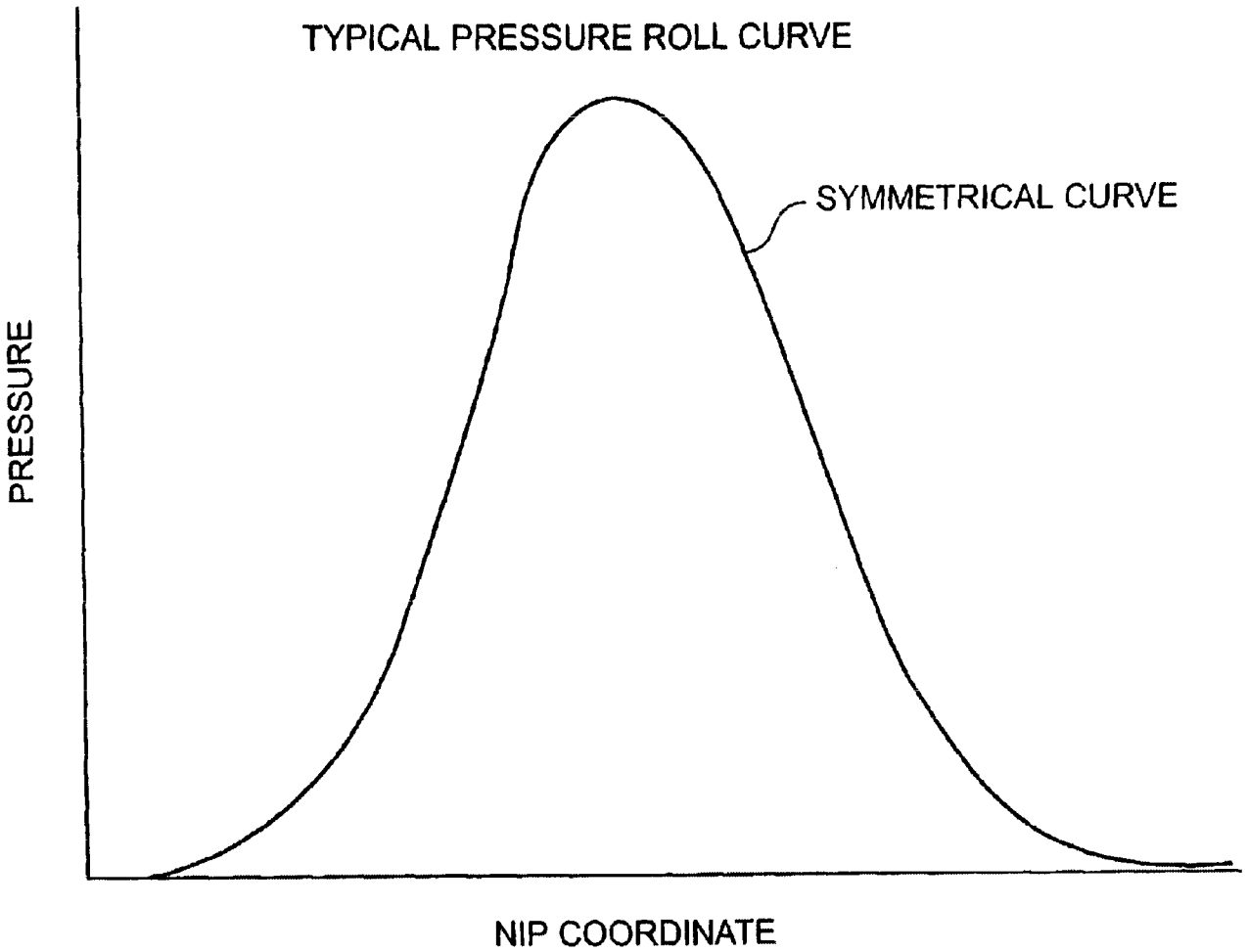
FIG. 6 illustrates a typical pressure profile in the nip of a suction pressure roll, backing roll, or transfer cylinder according to the prior art.
Figure 7:
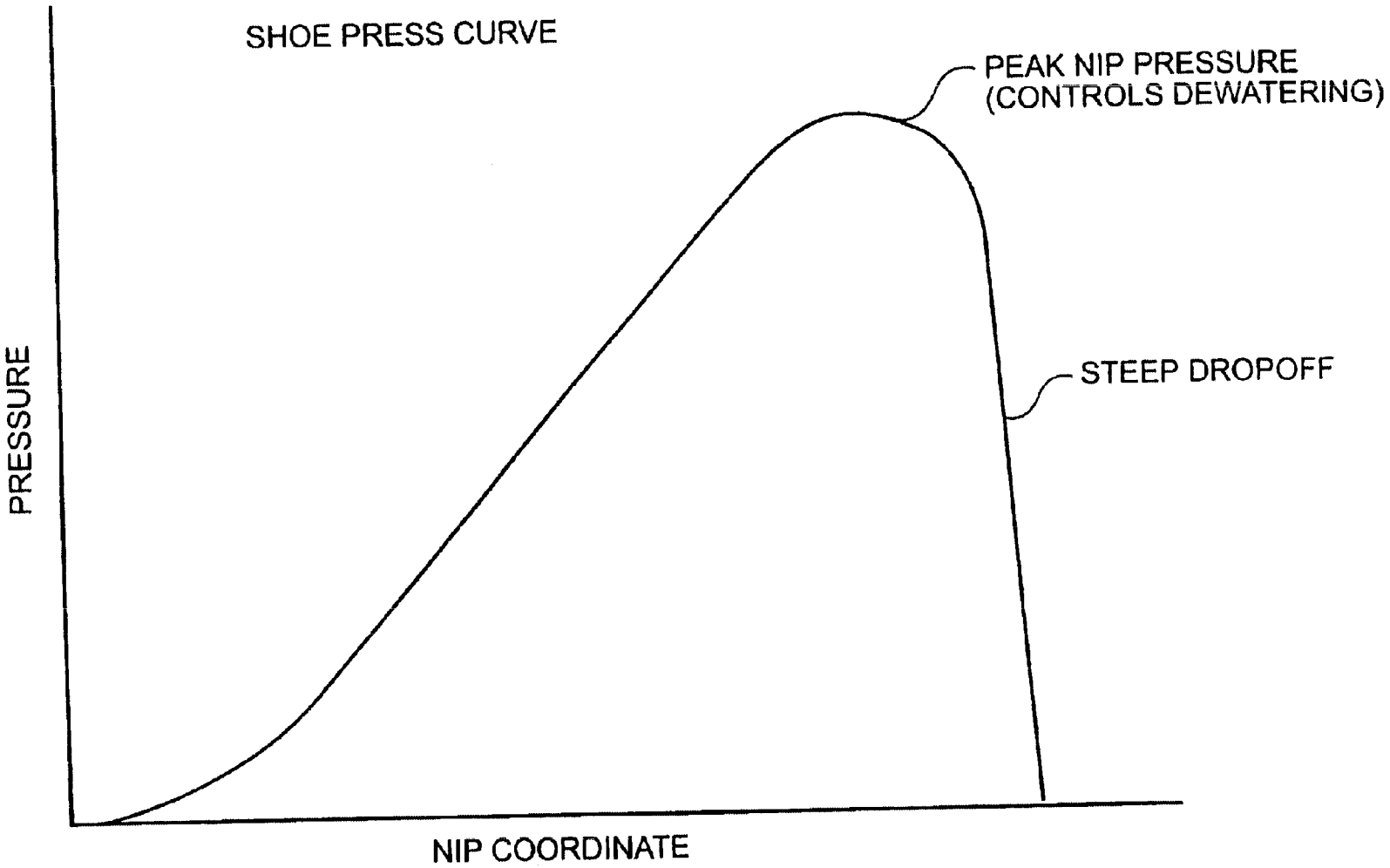
FIG. 7 illustrates a pressure profile in the nip of a shoe press.
Figure 8:
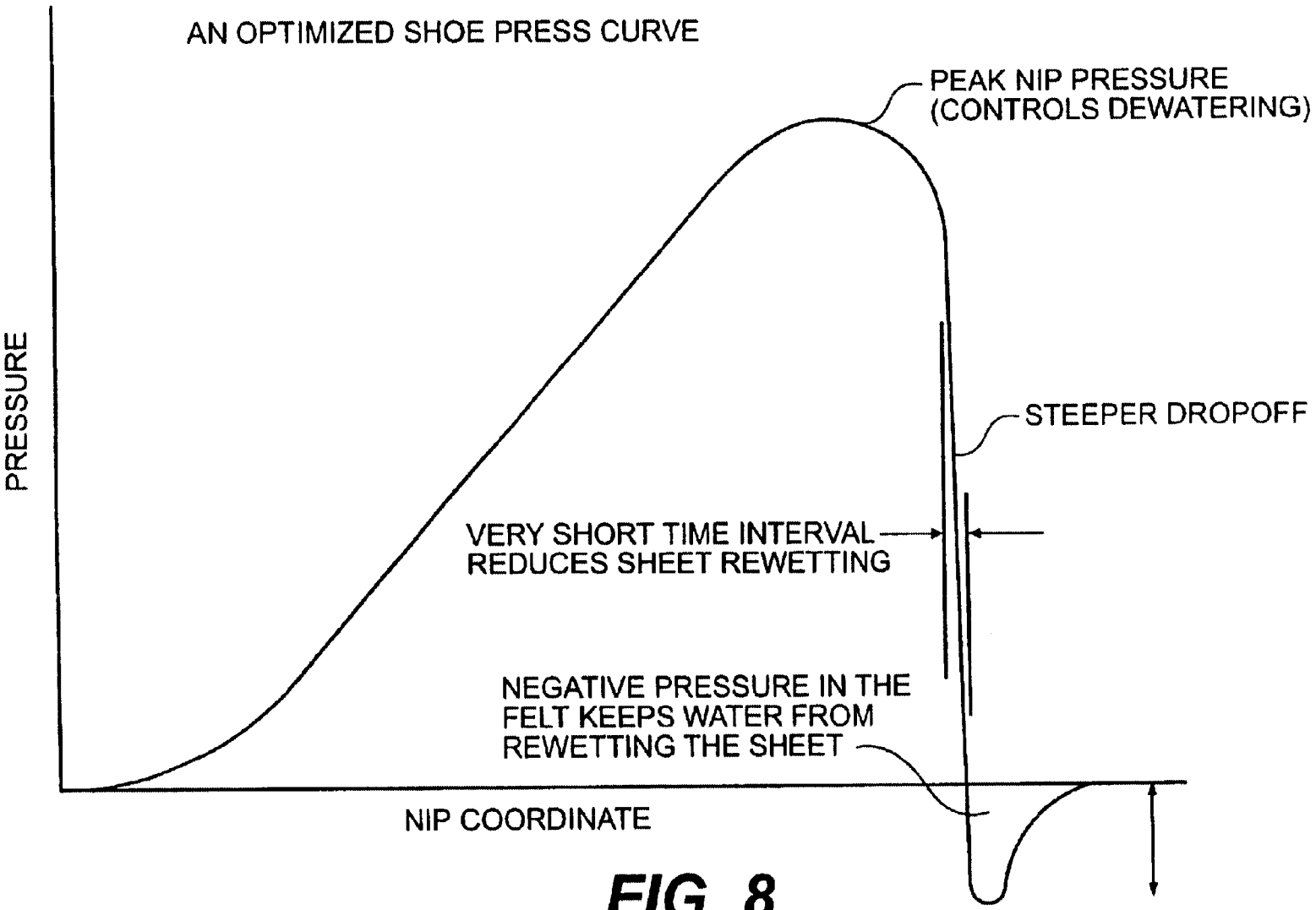
FIG. 8 illustrates a preferred pressure profile in the nip of a shoe press where the negative pressure corresponds to the vacuum level in the felt.

FIG. 6 shows a schematic sketch of a typical pressure distribution curve for a suction pressure roll described by symmetrical mathematical functions like the sine and haversine curves. Since the nip pressure is relieved when the nip diverges, rewet is exacerbated for the suction pressure roll. FIG. 7 shows a schematic sketch of a pressure distribution curve for a shoe press with a steep drop off where the felt is stripped from the sheet and later from the pressing blanket. Such a steep drop-off in pressure reduces the amount of rewet. FIG. 8 shows a schematic sketch of a pressure distribution curve for a shoe press with a steeper drop off and where suction occurs in the felt at the point of simultaneous separation of the felt, sheet, and blanket when the nip pressure reaches about zero. The negative pressure in the felt, when the blanket and felt are stripped apart, is caused by capillary forces and should aid in holding water in the felt and should help further dewater the web.

Figure 9:
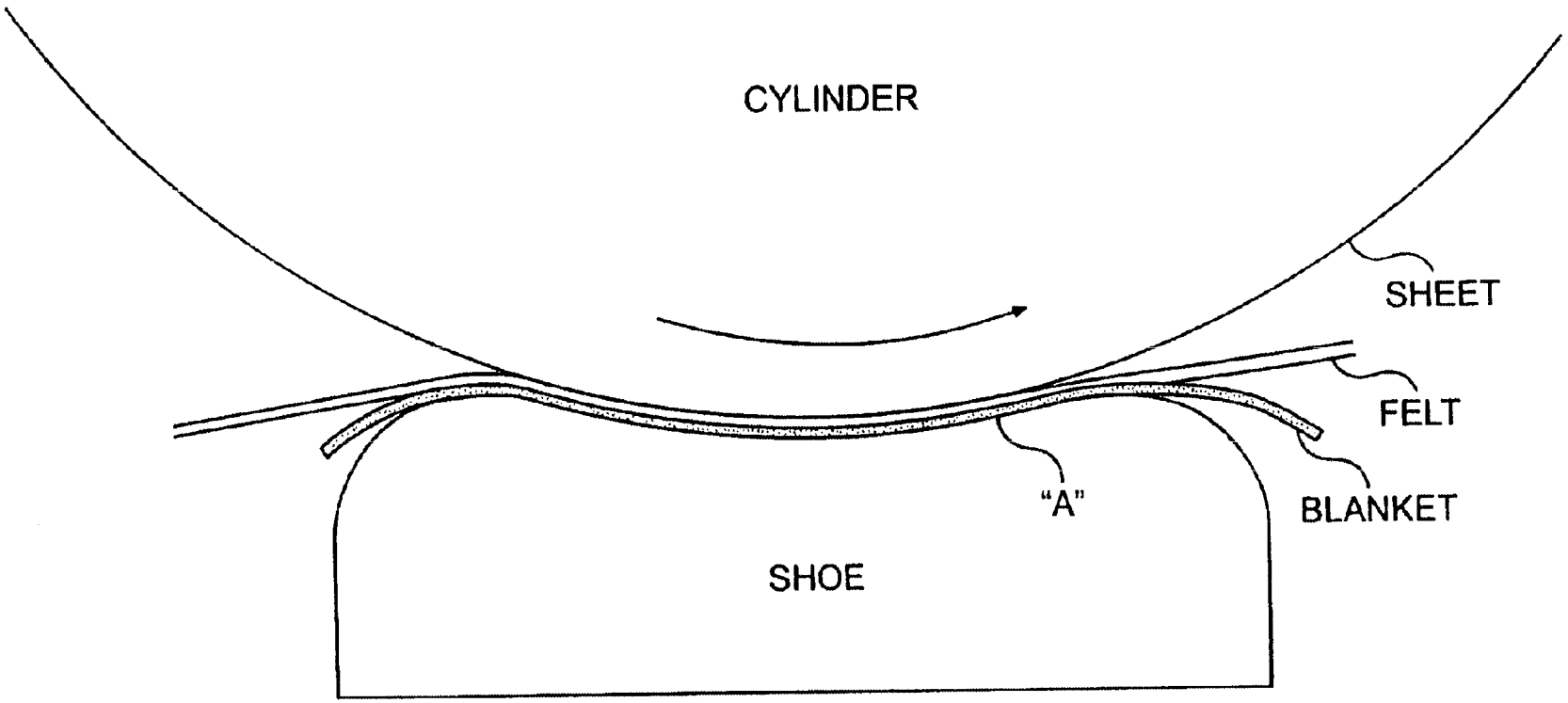
FIG. 9 illustrates a shoe press with a large diameter transfer cylinder where the felt rides the web causing rewet after the press nip.

Previous shoe, belt or blanket, and felt designs in wide nip presses do not permit optimum separation of these members. For instance, present designs allow for quick separation of the felt and blanket since the felt cannot "wrap" the unsupported blanket. But the drawback is that the felt stays in contact with the sheet allowing capillary flow back into the sheet, i.e., rewet (see FIG. 9). FIG. 9 is a schematic sketch of a shoe press nip showing sheet, felt, and blanket. Point A in FIG. 9 is the point of zero pressure on the pressure distribution curve at the exit side of the nip.

Rewet is determined in the literature by plotting moisture ratio versus the reciprocal of the basis weight using the following equation:

$$K_p = K_o = R/W$$

where $K_p$ is the moisture ratio of the paper after the wet press in grams of water per gram of fiber; $K_o$ is the moisture ratio of paper for 1/W=0; W is the basis weight in g/m$^2$; and R is the magnitude of the rewet of paper in g/m$^2$ and corresponds to the slope of the straight line used to fit moisture ratio versus reciprocal basis weight data. The aforementioned equation was first established by John Sweet. Data plotted according to the above equation is frequently referred to in the literature as a Sweet plot. The original work can be found in Sweet, J. S., Pulp and Paper Mag. Can., 62, No. 7: T267 (1961) and a review article can be found in Heller, H., MacGregor, M., and Bliesner, W., Paper Technology and Industry, p.154, June, 1975. Rewet is much more significant for lightweight tissue grades than heavy weight linerboard grades. Rewet has been estimated to be from 5 to 50 g/m$^2$ of water, depending on the felt, furnish, etc. Rewet for a conventional shoe press can be determined from the above equation. The amount of rewet for the optimum shoe press is preferably less than about 50% of the amount determined from Sweet's theory using a conventional shoe press system. Rewet is preferably from 0 to 10 g/m$^2$ of water, more preferably from 0 to 5 g/m$^2$ of water.

Figure 10:
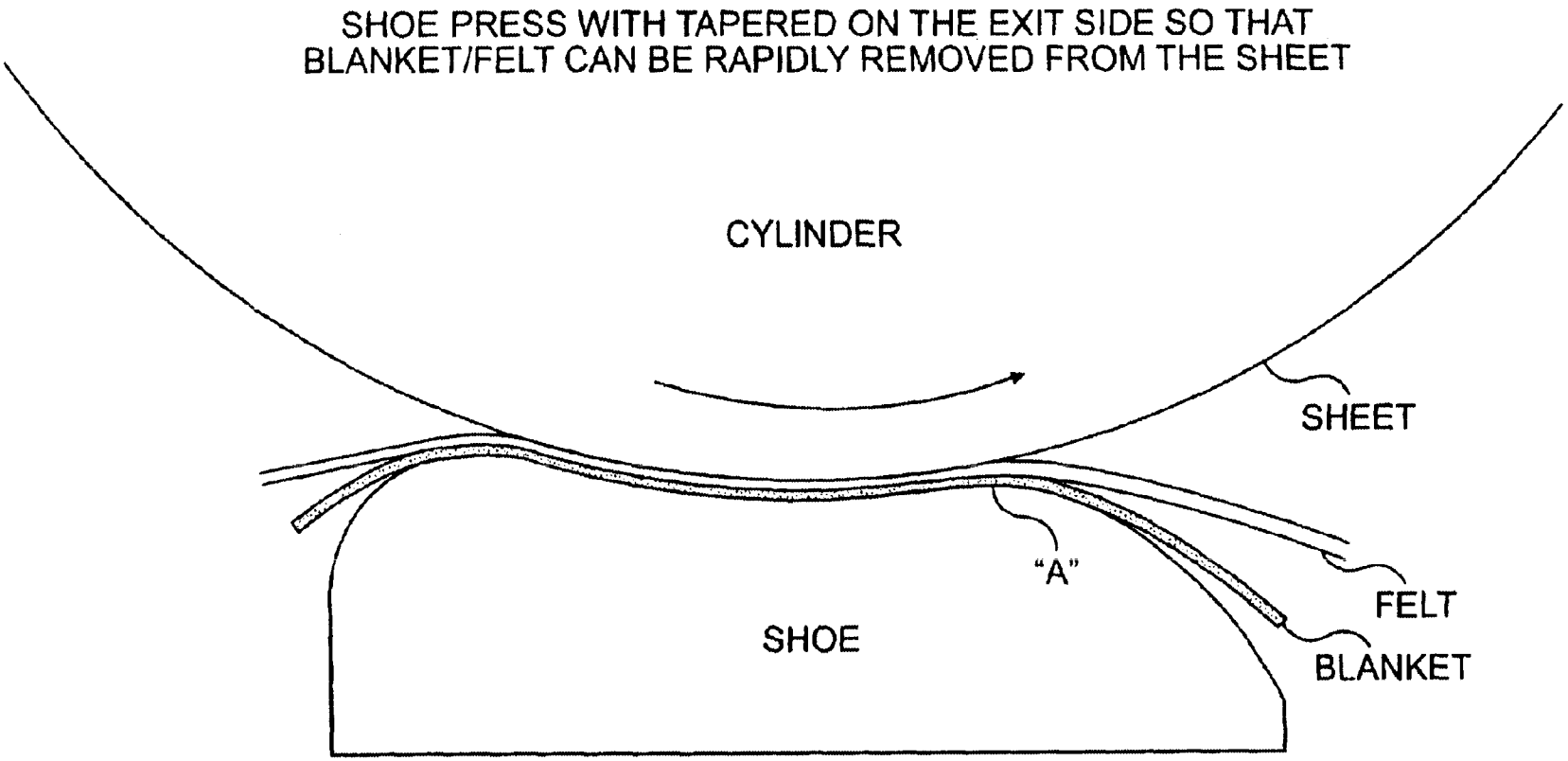
FIG. 10 illustrates a tapered shoe in a shoe press with a large diameter transfer cylinder where the felt is rapidly separated from the web but not from the pressing blanket.

According to another embodiment of the present invention, a pressing felt wraps the blanket and, therefore, pulls away quickly from the sheet reducing the time for possible rewetting. This design, as depicted in FIG. 10, can be achieved by altering the take-away angle of the felt from the nip and tapering the exit side of the shoe. To aid in blanket deflection from the felt at the exit side of the shoe, the blanket diameter can be reduced; the blanket can be eccentrically arranged with respects to the press plane; or a roll (not shown in FIG. 10) positioned against the blanket can deflect the belt further.

Figure 11:
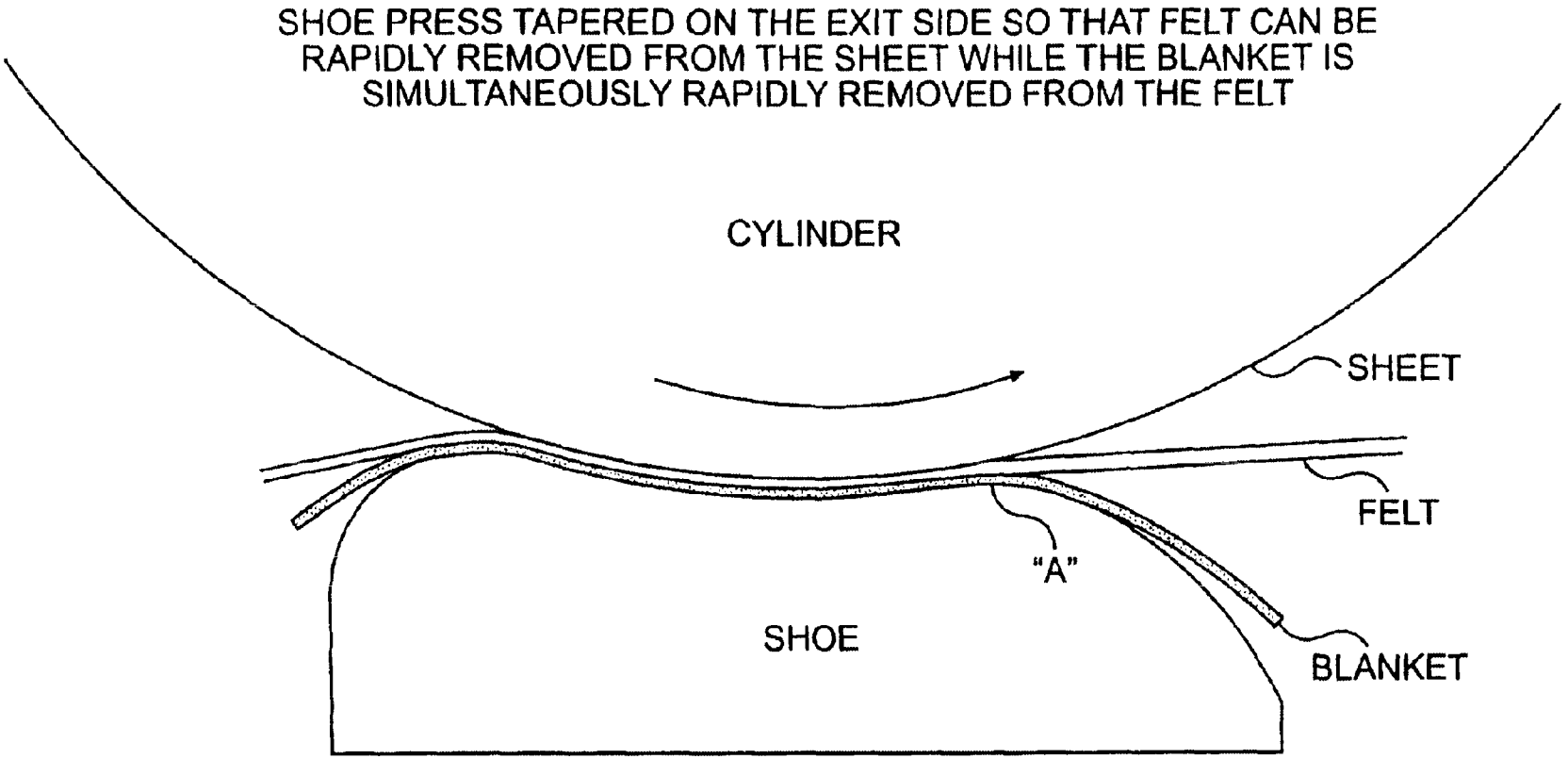
FIG. 11 illustrates a tapered shoe in a shoe press with a large diameter transfer cylinder where the felt is simultaneously stripped from the sheet and from the pressing blanket on the exit side of the nip.

FIG. 11 shows another embodiment according to the present invention. In FIG. 11, a schematic sketch of a shoe press showing a sheet, felt, and blanket is displayed. This shoe press utilizes a very steep pressure drop at and following the exit of a nip curve of the press while simultaneously, separating the felt from the blanket and from the sheet. In this manner, the negative pressure generated by surface tension forces as the felt and blanket separate are effective in reducing the flow of water back into the sheet as the felt and sheet are separated. The drawing shows a sharp drop off of the blanket near the shoe which in turn permits a quick separation of the felt from both the blanket and the sheet. The outgoing felt would be pulled at an angle that equally bisected the Yankee and blanket surfaces. Then by adjusting the tension on the felt, the exact point of separation can be controlled to affect the minimum in rewet. A felt drive roll located immediately following the shoe press can control the tension level on the felt. The objective of this embodiment according to the present invention is to affect the transfer of the sheet from the felt at the same time that the negative pulse caused by the separation of the felt and blanket occurs. This design not only minimizes the time the felt is in contact with the sheet; the added vacuum pulse will significantly reduce the amount of water that can flow, even over the short time. Point A in FIG. 11 is the point of zero pressure on the pressure distribution curve at the exit side of the nip. The nip pressure curve for the sheet/felt in FIG. 11 would most likely approach that shown in FIG. 8.

The web is preferably either adhered to the Yankee dryer by nip transfer with a pressing unit including a pressing blanket or is after pressing adhered to the Yankee dryer. The web is dried by steam and hot air impingement hoods. Any suitable art recognized adhesive might be used on the Yankee dryer. Preferred adhesives include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307. Typical release agents can be used in accordance with the present invention.

The final product may be calendered or uncalendered and is usually reeled to await further converting processes. The products according to the present invention may be subjected to any art recognized converting operations, including embossing, printing, etc.

The following example is illustrative of the invention embodied herein.

EXAMPLE 1

Figure 1:
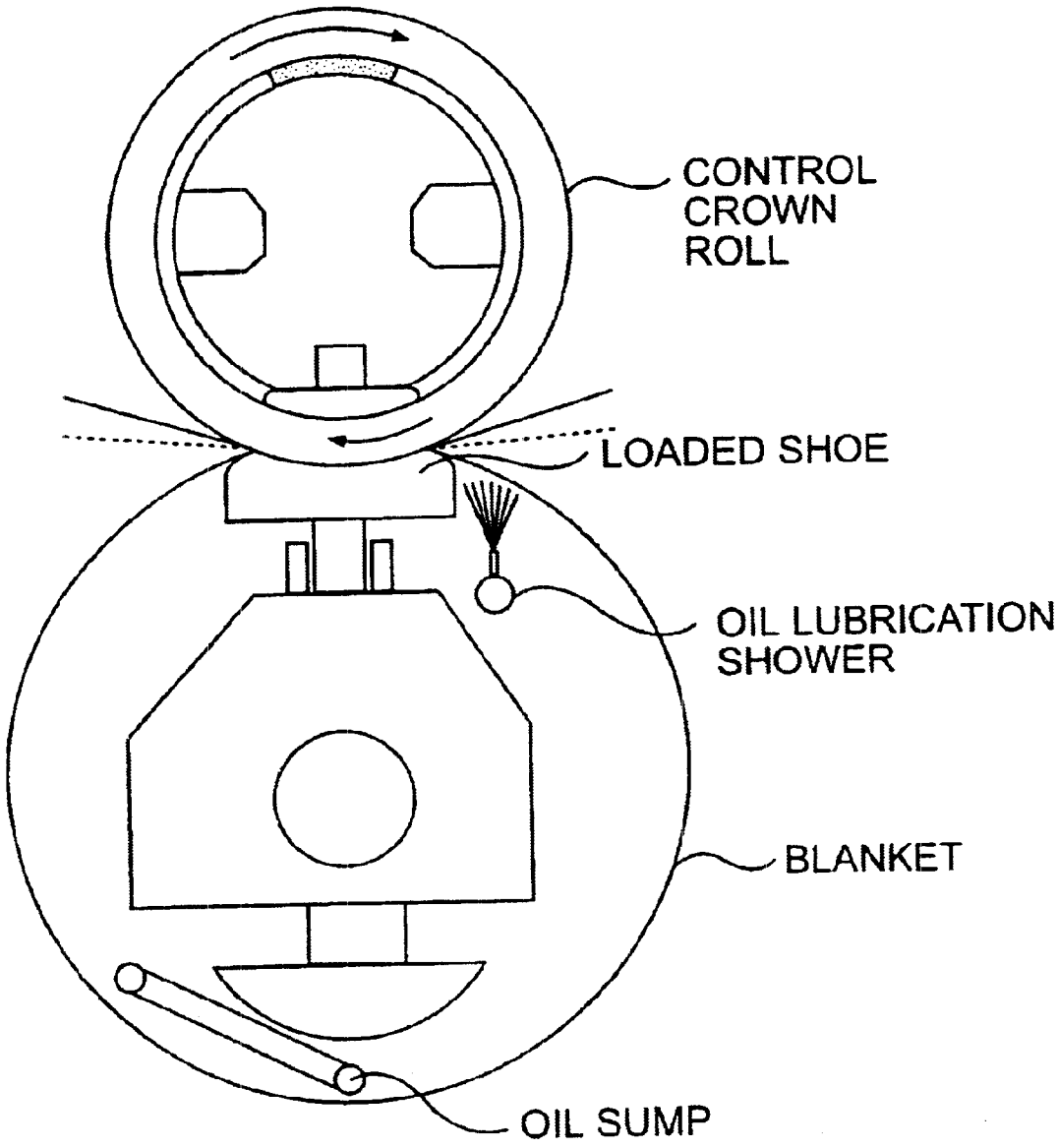
FIG. 1 PRIOR ART
FIG. 1 illustrates a side view of a typical stand alone shoe press.
Figure 2:
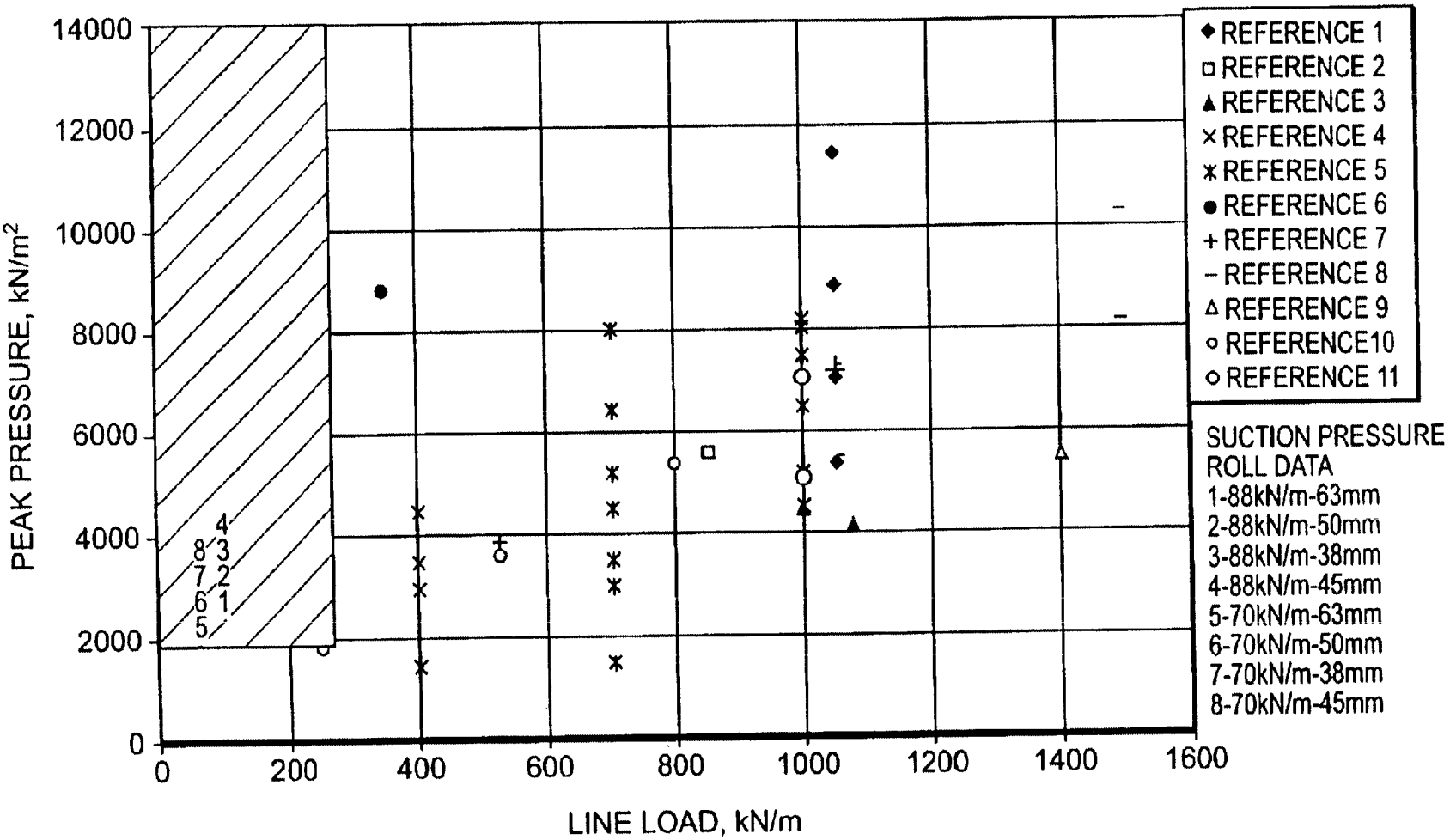
FIG. 2 illustrates the relationship between peak pressure and line load for a variety of shoe press arrangements found in the literature, as well as for Yankee suction pressure rolls.
Figure 3:
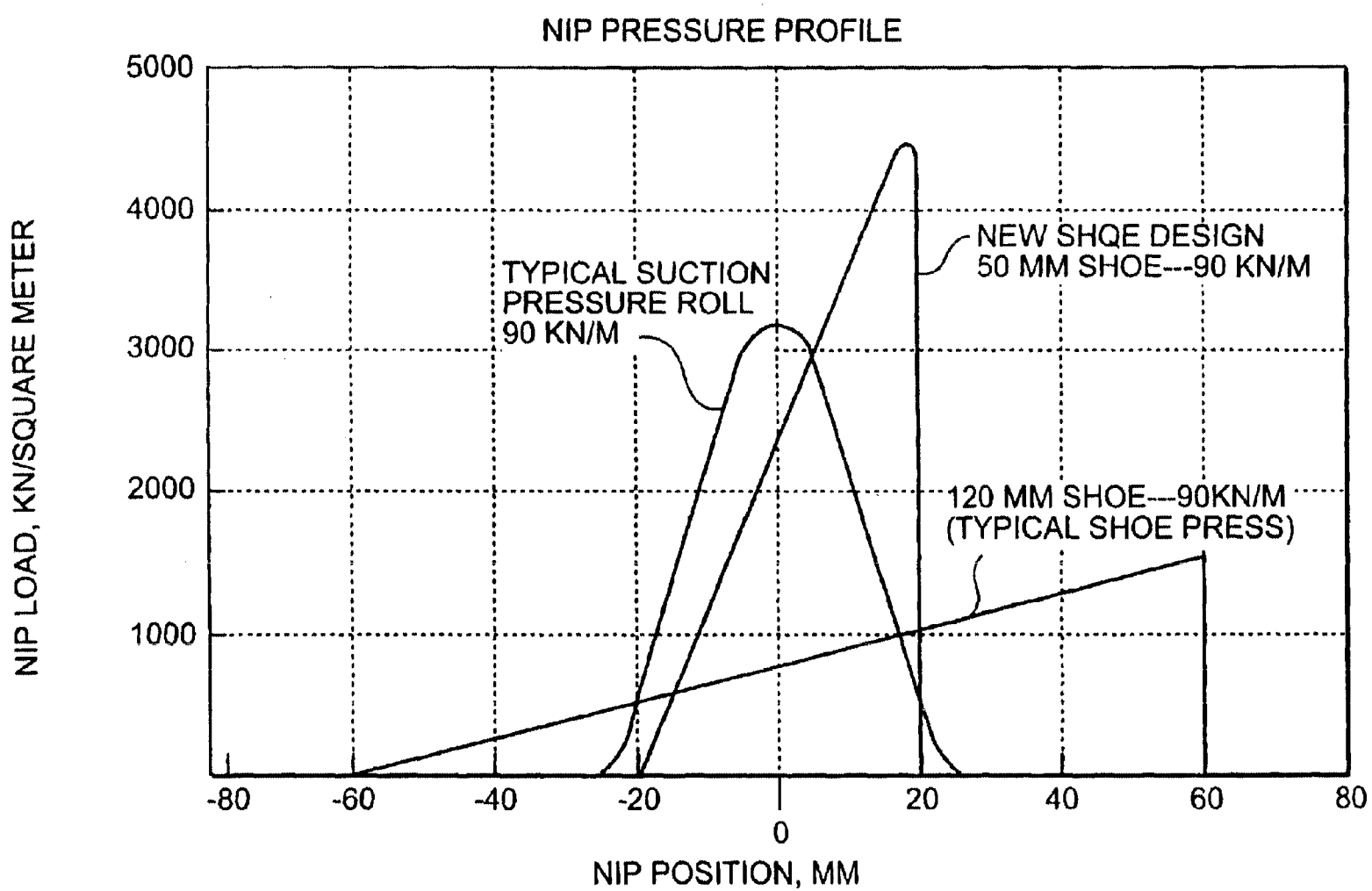
FIG. 3 illustrates nip pressure profiles for a suction pressure roll, a typical shoe press, and a shoe press made according to the present invention.
Figure 12:
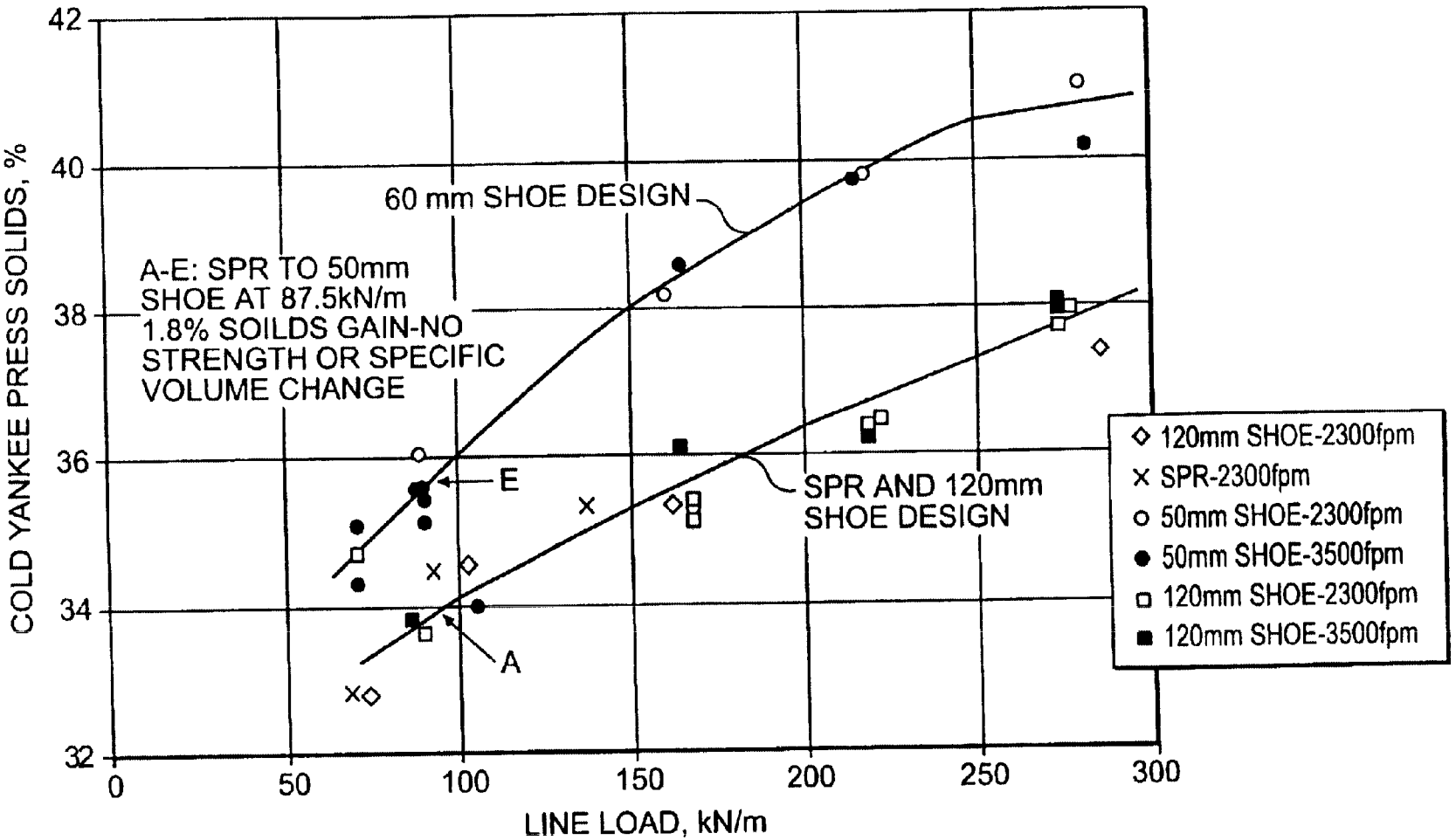
FIG. 12 shows a plot of cold Yankee press solids versus line loading for a conventional 120 mm shoe, for a 50 mm shoe made according to the present invention, and for a suction pressure roll.

A nascent web was formed on a Crescent-forming machine using a blend of 50/50 long fiber/short fiber refined to 23° SR freeness. Chemicals like wet strength agents or dry strength agents were not added to the stock. The basis weight of the sheet on the Yankee dryer was 8.5 lbs/3000 $ft^2$. Two pressing arrangements were used on the paper machine. In the first pressing arrangement, the sheet was pressed onto a Yankee dryer with a suction pressure roll. The vacuum in the suction roll was nominally 0.22 bar. In the second pressing arrangement, the suction pressure roll was replaced by a Yankee shoe press. The sheet was conditioned before the shoe press with a suction turning roll having the same size and open area as the suction pressure roll. The suction turning roll vacuum was nominally equivalent to the level used during the suction pressure roll experiments. After sheet conditioning, the web was pressed onto the Yankee with a shoe press. In order to obtain precise sheet solids data after the shoe press or the suction pressure roll, the Yankee dryer was run cold. Blotters were used to collect flatsheets for physical property determination. Two types of shoes were run: a typical 120 mm shoe and a 50 mm shoe. FIG. 3 shows the pressure distribution of the shoes and the suction pressure roll. FIG. 12 depicts a plot of sheet solids versus line loading. The typical 120 mm shoe shows no solids benefit versus the suction pressure roll at present operating line load limits of current Yankee dryers (i.e., approximately, 87.5 kN/m), while the 50 mm pressure optimized shoe press shows an advantage of several percentage points of solids. Furthermore, the strength and specific volume properties of a web made with the 50 mm pressure optimized shoe press were equivalent to the strength and specific volume properties of a web made by the suction pressure roll.

Figure 13:
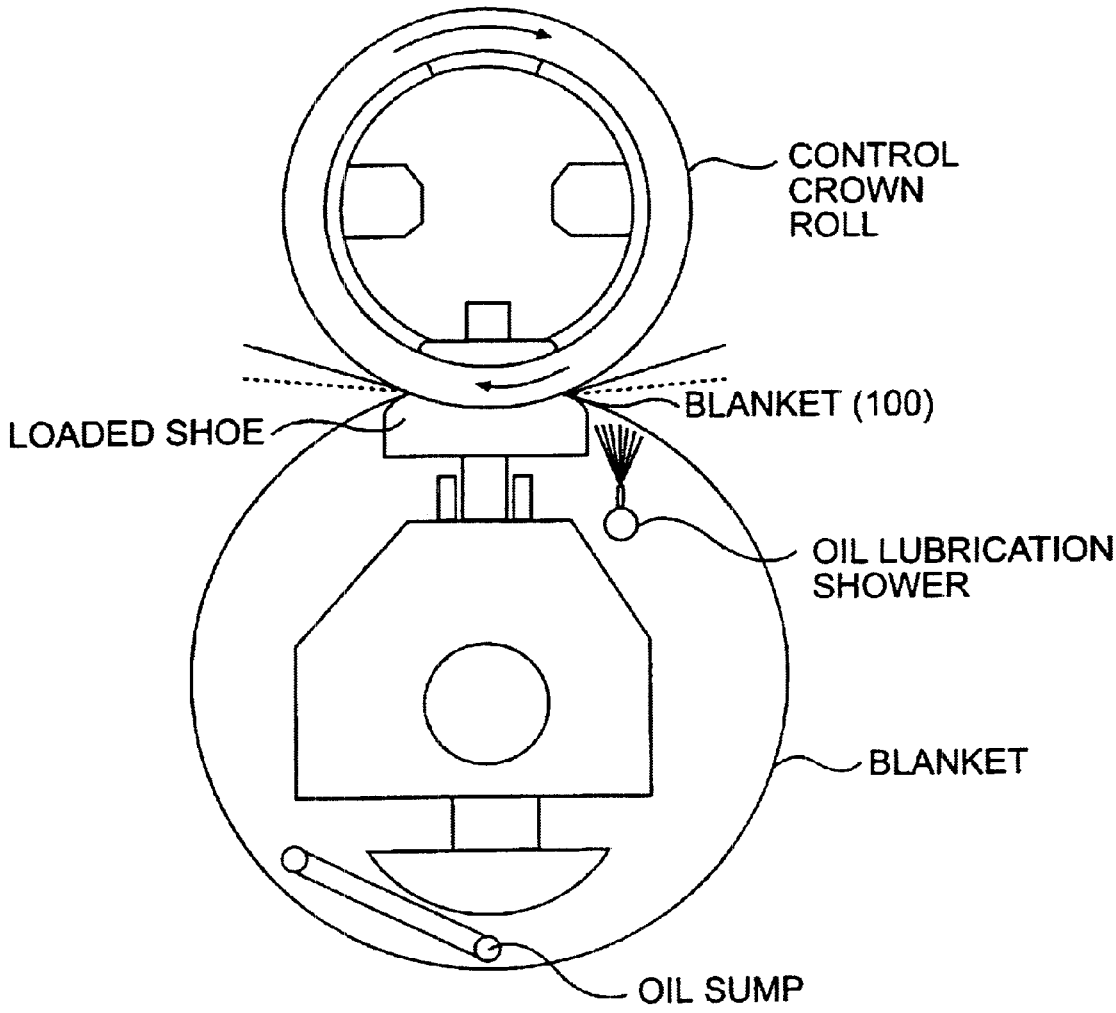
FIG. 13 illustrates a side view of a typical stand alone shoe press with a blanket having void space.
Figure 14:
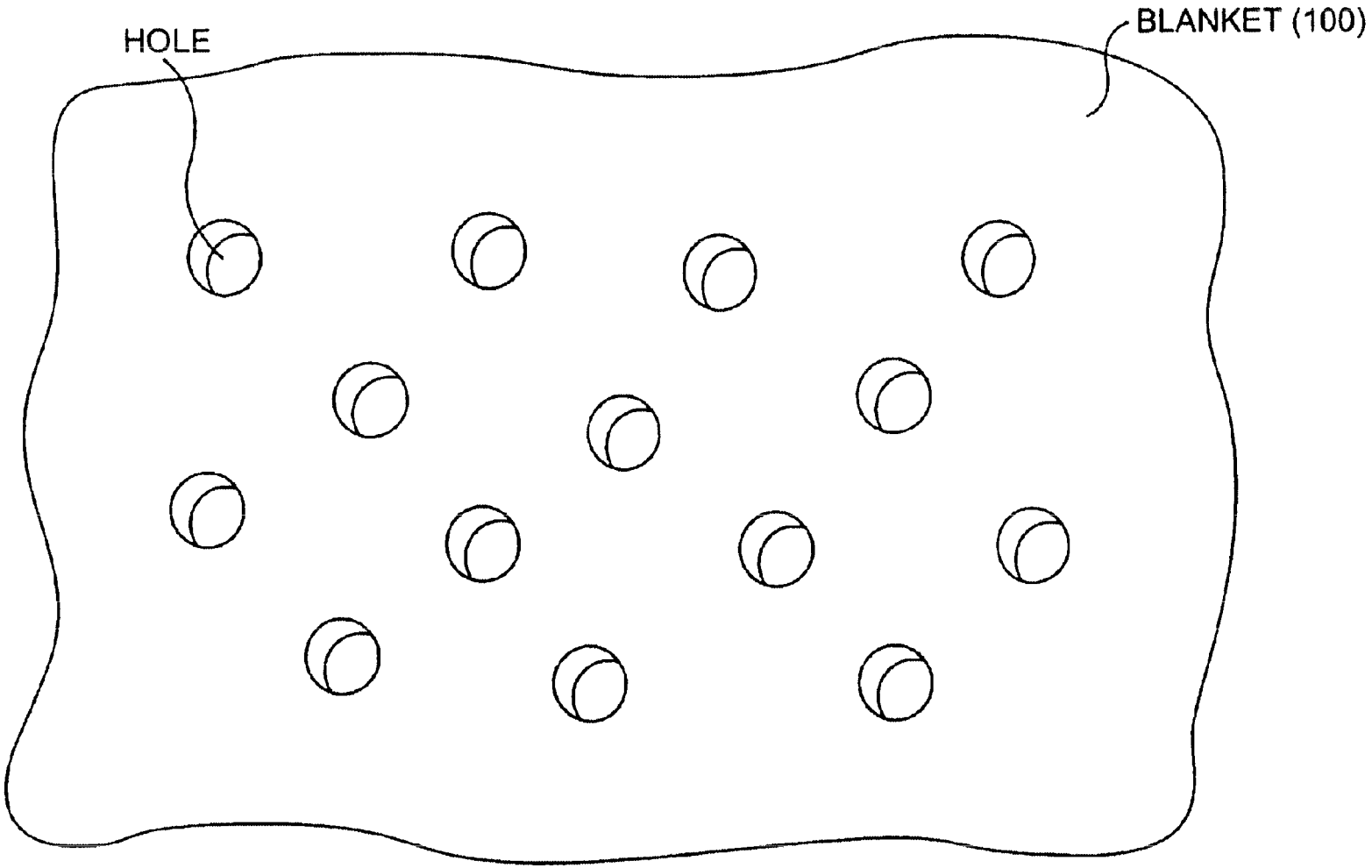
FIG. 14 illustrates a blind drilled blanket or belt.
Figure 15:
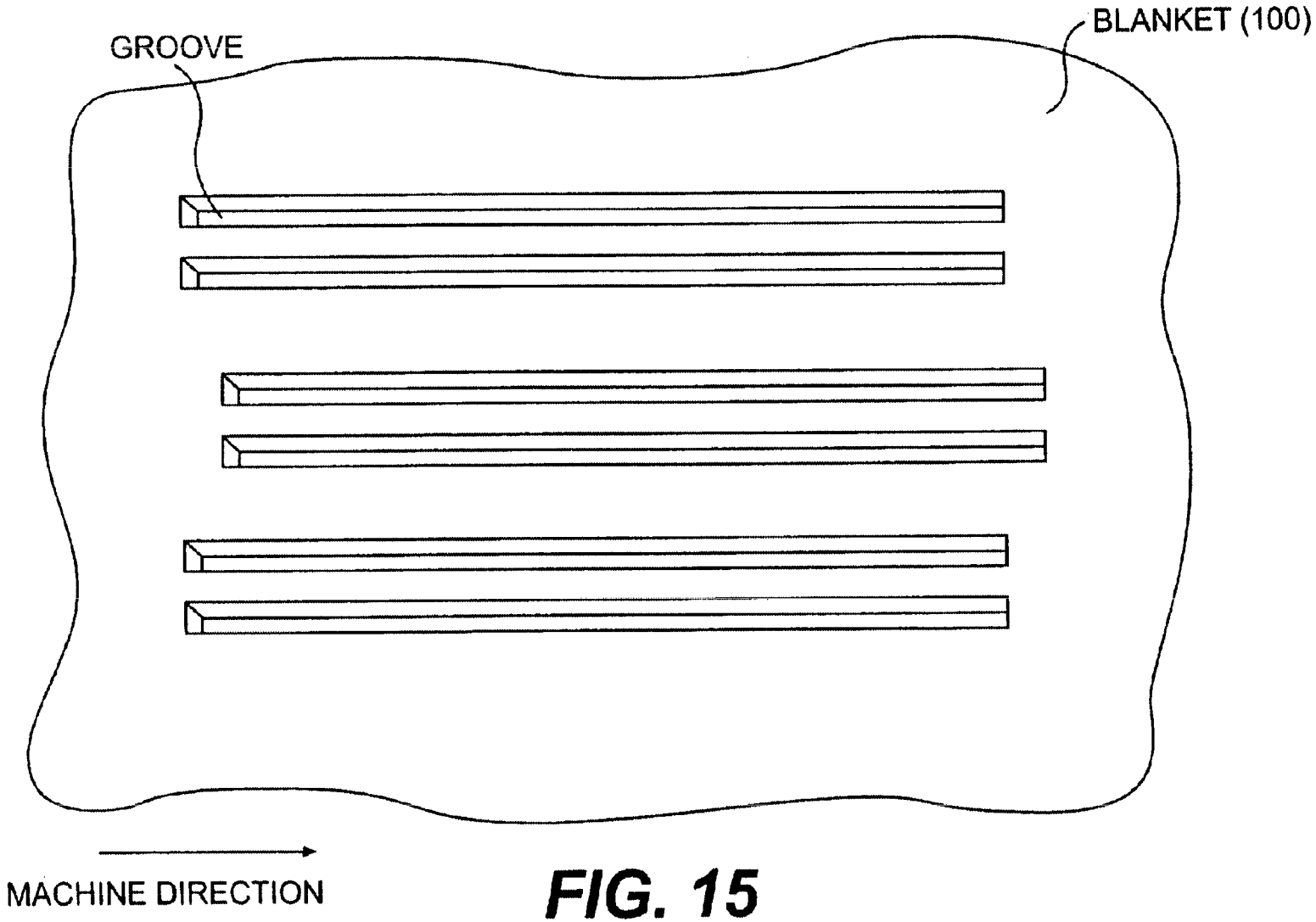
FIG. 15 illustrates a grooved blanket or belt.

FIGS. 13–15 illustrate a method for maximizing water removal in a press nip in accordance with another embodiment of the present invention. The present embodiment involves a conventional wet pressing (CWP) process. For consistency, like numbers have been used to indicate the corresponding portions of the apparatus depicted in FIGS. 13–15 with those of FIGS. 1–12. The description of the apparatus of FIGS. 1–12 thus applies equally to this embodiment, unless stated otherwise.

Referring to FIG. 13, the present embodiment uses a shoe press, preferably a controlled crown roll with a flexible shell and a concave shoe hydrodynamically loaded against one another. The present embodiment further includes a belt or blanket (100) having a void volume that enhances sheet solids after the shoe press to further improve water removal in the press nip. Appropriate void volume can be achieved by a number of blanket configurations, including, but not limited to, those made by grooving, blind drilling and the like. The total void volume of the belt or blanket for use according to the present invention is preferably about 50 to about 3000 $cm^3/m^2$, more preferably about 100 to about 1000 $cm^3/m^2$, most preferably from about 200 to about 500 $cm^3/m^3$.

Blankets for use according to the present invention can include any art recognized blanket having, or which can be modified to have, the required void volume.

For example, blankets disclosed by E. J. Justus and D. Cronin in Tappi, August 1964, Vol. 47, No. 8, p. 493, which is incorporated herein by reference, include grooved belts that improve water removal in a press nip where the groove width is about 0.01 to about 0.03 in., the land width is about 2 to about 20 times the groove width and the groove depth is about 2 to about 10 times the groove width.

For another example, blankets disclosed by Bo-Christer Aberg in Das Papier No. 6, 1996, which is incorporated herein by reference, include grooved belts that work at higher line loads and machine speeds than smooth belts. The belts have groove widths of about 0.5 to about 1 mm and a void volume of about 100 $cc/m^2$ to about 500 $cc/m^2$.

For yet another example, blankets disclosed by P. Slater and K. Fitzpatrick in the $84^{th}$ Annual Meeting of the Technical Section, CPPA, January 1998, which is incorporated herein by reference, include grooved belts that provide a press dryness about 1% to about 3% greater than the press dryness obtained with a similar smooth belt. The belts have groove widths of about 0.58 to about 0.79 mm and a void volume of about 200 $cc/m^2$ to about 365 $cc/m^2$.

For still another example, blankets disclosed by D. Madden et al. in the Tappi 1998 Engineering Conference, which is incorporated herein by reference, include grooved belts that provide a press dryness about 1% greater than the dryness obtained with a blind drilled belt. The grooved belt has an open area of about a 20.3% and a void volume of about 260 $cc/m^2$, and the blind drilled belt has an open area of about 21% and a void volume of about 380 $cc/m^2$ void volume.

Referring to FIG. 14, blind drilling involves drilling holes into a smooth blanket, as will be understood by one of skill in the art. Nip compression between a blind drilled blanket and the felt causes a hydraulic pressure gradient between the holes in the blanket and the felt which improves water flow and removal.

The blind drilled blanket preferably has a plurality of holes sequentially arranged in the machine direction and a plurality of rows sequentially arranged in the cross-machine direction to cause a hydraulic pressure gradient. The blind drilled blanket can take a variety of configurations. For example, the hole depth, hole diameter, hole spacing, hole angle, hole geometry, row spacing and/or row pattern can be varied.

In particular, the hole depth can range from about 0.2 to about 10 mm, more preferably about 0.5 to about 5 mm, most preferably from about 0.5 to about 3 mm. Also, the hole depth can extend partially or completely through the blanket.

The hole diameter can range from about 0.2 to about 10 mm, more preferably about 0.5 to about 5 mm, most preferably from about 1 to about 3 mm.

The hole spacing can range from about 1 to about 20 mm between holes arranged within the same row, more preferably about 1 to about 10 mm, most preferably from about 1 to about 5 mm.

The hole angle (i.e., the angle measured from the surface of the belt material counterclockwise to the side of the hole) can range from about 45 to about 135 degrees along any wall in either the machine or cross-machine, more preferably about 70 to about 110 degrees, most preferably from about 80 to about 100 degress.

The row spacing can range from a about 1 to about 20 mm, more preferably about 1 to about 10 mm, most preferably from about 1 to about 5 mm.

The hole geometry can be curved, linear or curvilinear, e.g. round, square, elliptical, polygonal, and the row pattern can be such that the holes in each row are aligned in the cross-machine direction, offset in the cross-machine direction, aligned in the machine direction, offset in the machine direction and the like.

There is no requirement that all holes have the same configuration, rather, each of the holes can have a different configuration, or one or more individual or set of holes can have the same configuration as one or more other individual or set of holes. Further, there is no requirement that the hole pattern form any type of geometric or other pattern, for example, the pattern can be random.

Referring to FIG. 15, forming grooves in the blanket involves removing elongated sections, as will be understood by one of skill in the art. Nip compression of the grooved blanket and the press felt causes a hydraulic pressure gradient in the machine direction, which improves water flow and removal.

The grooved blanket preferably has a plurality of grooved sections sequentially arranged in the cross-machine direction that circumscribe the blanket to cause machine direction water movement. The grooved blanket can take a variety of configurations. For example, the groove depth, groove width, groove bevel, groove angle, land width, open area and groove pattern can all be varied.

In particular, the groove depth can range from about 0.1 to about 8 mm, more preferably about 0.2 to about 5 mm, most preferably from about 0.4 to about 3 mm.

The groove width can range from about 0.1 to about 6 mm, more preferably about 0.2 to about 4 mm, most preferably from about 0.4 to about 3 mm.

The groove bevel (i.e., the angle measured from the surface of the belt material counterclockwise to the side of the groove minus 90°) can range from about 0 to about 45°, more preferably about 0 to about 30°, most preferably from about 0 to about 20°.

The groove angle can range from about 45 to about 135 degrees (with 90 degrees being orthogonal to the cross-machine direction), more preferably about 65 to about 115°, most preferably from about 80 to about 100°.

The land width can range from about 0.2 to about 25 mm, more preferably about 0.4 to about 10 mm, most preferably from about 0.6 to about 4 mm.

The open area can range up to 80% of the total blanket area, more preferably about 15 to about 50%, most preferably from about 20 to about 40%.

The groove pattern can be such that the grooves in each row are aligned in the cross-machine direction, offset in the cross-machine direction, aligned in the machine direction, offset in the machine direction and the like. Also, for blankets for use in the present invention, grooves need not have the same configuration, rather, all the grooves can have a different configuration, or one or more individual or set of grooves can have the same configuration as one or more other individual or set of grooves. Further, there is no requirement that the groove pattern form any type of geometric or other pattern, for example, the groove placement can also be random.

Blankets having the disclosed void volume will be readily apparent to the skilled artisan. Such blankets can include any physical arrangement as long as the void space requirements are satisfied. Blankets for use in the present invention may be manufactured by any art recognized process, including but not limited to, casting molding, laser engraving, etc.

EXAMPLE 2

A punch press was used to perform dewatering experiments with different belt structures. An AMFlex 3S felt manufactured by Appleton Mills Corporation was used to dewater the paper web. The web basis weight was 8.9 lbs/rm. The felt dryness was controlled to 69.3% dryness by using blotters and a couch roll to remove excess water. Web moisture was controlled to 19.3% dryness by rewetting moist webs using a water spray. The webs were made from a 50/50 blend of northern softwood kraft and eucalyptus refined in a PFI mill to 510 ml CSF.

A smooth belt, a blind drilled belt and a grooved belt were used in the punch press experiment. The blind drilled belt had a bore area of 3.82 $mm^2$, a bore depth of 1.76 mm, an open area of 22.73% and a void volume of 402.9 $cc/m^2$. The grooved belt had a groove width of 0.66 mm, a groove depth of 1.41 mm, a pitch of 0.33 grooves/mm, an open area of 21.78%, and a void volume of 270.6 $cc/m^2$.

The punch press was operated such that the average nip pressure was fixed at 400 psi and the average nip dwell time was fixed at 1.8 ms. The experimental post press dryness results for the experiment were:

| | |
|---|---|
| smooth belt | 31.0 +/− 0.30% |
| blind drilled belt | 39.2 +/− 0.28% |
| grooved belt | 40.3 +/− 0.42% |

with the +/− percentage being the 95% confidence limit for the test.

These results indicate that pressing with either a blind drilled or grooved belt leads to enhanced sheet solids when compared to a smooth belt. These results also indicate that pressing with a grooved belt leads to enhanced sheet solids over a blind drilled belt.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. An apparatus for forming an absorbent paper sheet product comprising:

a moving foraminous endless fabric;

means for depositing a nascent web for said absorbent paper sheet on said faraminous endless fabric;

a moving endless pressing blanket for pressing said absorbent paper sheet on said foraminous endless fabric, said moving endless pressing blanket having a void volume of less than about 1500 $cm^3/m^2$;

a transfer cylinder; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$ at an overall line load of less than about 240 kN/m, and wherein said pressing unit does not include suction pressure rolls.

2. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a transfer cylinder; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$, and wherein said pressing unit does not include suction pressure rolls.

3. The apparatus of claims 1 or 2, wherein said pressing unit is additionally configured to impose an asymmetrical pressure distribution upon said nascent web, said asymmetrical pressure distribution being skewed such that the pressure declines from a peak pressure to a value of 20% of said peak pressure over a nip length which is no more than about half of the nip length over which it rose to said peak pressure from 20% of said peak pressure.

4. The apparatus of claims 1 or 2, wherein said pressing unit comprises at least one hydraulic engagement member.

5. The apparatus of claim 4, wherein said at least one hydraulic engagement member has a length of less than about 3 inches.

6. The apparatus of claim 5, wherein said at least one hydraulic engagement member has a length of less than about 2 inches.

7. The apparatus of claims 1 or 2, wherein said foraminous endless fabric is a press felt or an impression blanket.

8. The apparatus of claims 1 or 2, wherein the means for forming a nascent web is selected from a crescent former, a twin wire former, a suction breast roll former, or a fourdrinier former.

9. The apparatus of claims 1 or 2, wherein said pressing unit is configured to have a line load of less than about 175 kN/m.

10. The apparatus of claims 1 or 2, wherein said pressing unit is configured to have a line load of less than about 100 kN/m.

11. The apparatus of claims 1 or 2, wherein said nip is at least about 2500 kN/m$^2$.

12. The apparatus of claims 1 or 2, wherein said nip is at least about 3000 kN/m$^2$.

13. The apparatus of claims 1 or 2, wherein said nip is at least about 3150 kN/m$^2$.

14. The apparatus of claims 1 or 2, further comprising a creping blade for removing said absorbent paper sheet from said transfer cylinder.

15. The apparatus of claims 1 or 2, wherein said pressing unit is configured to disengage said web from said foraminous endless fabric such that rewet of said nascent web by said foraminous endless fabric is less than about 50% of the rewet predicted by the Sweet equations based upon the properties of said foraminous endless fabric and said nascent web.

16. The apparatus of claim 15, wherein said pressing unit is configured to disengage said web from said foraminous endless fabric at a nip length of less than about one inch from the point the nip pressure reaches zero.

17. The apparatus of claim 15, wherein said pressing unit is configured to both disengage said web from said foraminous endless fabric and disengage said foraminous endless fabric from said pressing blanket at a nip length of less than about one inch from the point the nip pressure reaches zero.

18. The apparatus of claims 1 and 2, wherein said transfer cylinder is heated.

19. The apparatus of claim 18, wherein said transfer cylinder is heated by an induction heater.

20. The apparatus of claims 1 and 2, wherein said transfer cylinder is selected from a granite roll, a cold steel roll, a gas fired heater, or a Yankee drying cylinder.

21. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a backing roll; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$ at an overall line load of less than about 240 kN/m, and wherein said pressing unit does not include suction pressure rolls.

22. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a backing roll; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$, and wherein said pressing unit does not include suction pressure rolls.

23. The apparatus of claims 21 or 22, wherein said pressing unit is additionally configured to impose an asymmetrical pressure distribution upon said nascent web, said asymmetrical pressure distribution being skewed such that the pressure declines from a peak pressure to a value of 20% of said peak pressure over a nip length which is no more than about half of the nip length over which it rose to said peak pressure from 20% of said peak pressure.

24. The apparatus of claims 21 or 22, wherein said pressing unit comprises at least one hydraulic engagement member.

25. The apparatus of claim 24, wherein said at least one hydraulic engagement member has a length of less than about 3 inches.

26. The apparatus of claim 25, wherein said at least one hydraulic engagement member has a length of less than about 2 inches.

27. The apparatus of claims 21 or 22, wherein said foraminous endless fabric is a press felt or an impression blanket.

28. The apparatus of claims 21 or 22, wherein the means for forming a nascent web is selected from a crescent former, a twin wire former, a suction breast roll former, or a fourdrinier former.

29. The apparatus of claims 21 or 22, wherein said backing roll is heated.

30. The apparatus of claim 29, wherein said backing roll is heated by steam.

31. The apparatus of claim 29, wherein said backing roll is heated by induction heating.

32. The apparatus of claims 21 or 22, wherein said pressing unit is configured to have a line load of less than about 175 kN/m.

33. The apparatus of claims 21 or 22, wherein said pressing unit is configured to have a line load of less than about 100 kN/m.

34. The apparatus of claims 21 or 22, wherein the pressure at said nip is at least about 2500 kN/m$^2$.

35. The apparatus of claims 21 or 22, wherein the pressure at said nip is at least about 3000 kN/m$^2$.

36. The apparatus of claims 21 or 22, wherein the pressure at said nip is at least about 3150 kN/m$^2$.

37. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a transfer cylinder; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$ at an overall line load of less than about 240 kN/m, and wherein said pressing unit comprises at least one hydraulic engagement member.

38. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a transfer cylinder; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$, and wherein said pressing unit comprises at least one hydraulic engagement member.

39. The apparatus of claims 37 or 38, wherein said at least one hydraulic engagement member has a length of less than about 3 inches.

40. The apparatus of claim 39, wherein said at least one hydraulic engagement member has a length of less than about 2 inches.

41. An apparatus for forming an absorbent paper sheet product comprising;

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a backing roll; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 kN/m$^2$ at an overall line load of less than about 240 kN/m, and wherein said pressing unit comprises at least one hydraulic engagement member.

42. An apparatus for forming an absorbent paper sheet product comprising:

a moving foraminous endless fabric;

means for depositing a nascent web for said absorbent paper sheet on said foraminous endless fabric;

a moving endless pressing blanket for pressing said absorbent paper sheet on said foraminous endless fabric, said moving endless pressing blanket having a void volume of less than about 1500 cm$^3$/m$^2$;

a backing roll; and a pressing unit engaging said pressing blanket adapted to urge said nascent web for said absorbent paper sheet on said foraminous endless fabric into engagement with said transfer cylinder thereby forming a nip between said foraminous endless fabric and said transfer cylinder, wherein no pervious member is interposed between said transfer cylinder and said foraminous endless fabric, said pressing unit being configured to create a peak engagement pressure of at least about 2000 $kN/m^2$, and wherein said pressing unit comprises at least one hydraulic engagement member.

43. The apparatus of claims 41 or 42, wherein said pressing unit is additionally configured to impose an asymmetrical pressure distribution upon said nascent web, said asymmetrical pressure distribution being skewed such that the pressure declines from a peak pressure to a value of 20% of said peak pressure over a nip length which is no more than about half of the nip length over which it rose to said peak pressure from 20% of said peak pressure.

44. The apparatus of claims 41 or 42, wherein said at least one hydraulic engagement member has a length of less than about 3 inches.

45. The apparatus of claim 44, wherein said at least one hydraulic engagement member has a length of less than about 2 inches.

* * * * *

UNITED STATES PATENT AND TRADEMARK OFFICE

CERTIFICATE OF CORRECTION

PATENT NO. : 6,669,821 B2
DATED : December 30, 2003
INVENTOR(S) : Steven L. Edwards et al.

It is certified that error appears in the above-identified patent and that said Letters Patent is hereby corrected as shown below:

Column 22,
Line 63, after "a transfer cylinder", insert -- , wherein said nascent web is located between said foraminous endless fabric and said transfer cylinder --.

Column 23,
Line 19, after "a transfer cylinder", insert -- , wherein said nascent web is located between said foraminous endless fabric and said transfer cylinder --.

Column 24,
Lines 33 and 56, after "a backing roll", insert -- , wherein said nascent web is located between said foraminous endless fabric and said backing roll --.
Lines 38, 39-40, 41, 60, 61-62 and 63, "transfer cylinder" should read -- backing roll --.

Column 25,
Line 55, after "a transfer cylinder", insert -- , wherein said nascent web is located between said foraminous endless fabric and said transfer cylinder --.

Column 26,
Line 11, after "a transfer cylinder", insert -- , wherein said nascent web is located between said foraminous endless fabric and said transfer cylinder --.
Lines 39 and 61, after "a backing roll", insert -- , wherein said nascent web is located between said foraminous endless fabric and said backing roll --.
Lines 43, 44-45, 46, 66 and 67, "transfer cylinder" should read -- backing roll --.

Column 27,
Lines 1 and 2, "transfer cylinder" should read -- backing roll --.

Signed and Sealed this

Eighth Day of June, 2004

JON W. DUDAS
*Acting Director of the United States Patent and Trademark Office*